US005918581A

United States Patent [19]

Uto et al.

[11] Patent Number: 5,918,581

[45] Date of Patent: Jul. 6, 1999

[54] EVAPORATIVE EMISSION CONTROL SYSTEM FOR INTERNAL COMBUSTION ENGINES

[75] Inventors: Hajime Uto, Kawachi; Toshiaki Ichitani, Utunomiya; Ryuji Fujino, Utsunomiya; Yoshio Nuiya; Takeshi Suzuki, both of Utunomiya, all of Japan

[73] Assignee: Honda Giken Kogyo Kabushiki Kaisha, Tokyo, Japan

[21] Appl. No.: 09/021,004

[22] Filed: Feb. 9, 1998

[30] Foreign Application Priority Data

| | | | |
|---|---|---|---|
| Feb. 10, 1997 | [JP] | Japan | 9-039740 |
| Feb. 21, 1997 | [JP] | Japan | 9-052509 |
| Feb. 24, 1997 | [JP] | Japan | 9-054271 |
| Feb. 26, 1997 | [JP] | Japan | 9-057121 |
| Feb. 27, 1997 | [JP] | Japan | 9-058565 |

[51] Int. Cl.[6] ..... F02M 37/04

[52] U.S. Cl. ..... 123/520; 123/198 D; 123/518

[58] Field of Search ..... 123/516, 518, 123/519, 520

[56] References Cited

U.S. PATENT DOCUMENTS

| | | | |
|---|---|---|---|
| 5,119,791 | 6/1992 | Gifford et al. | 123/516 |
| 5,193,511 | 3/1993 | Fujino | 123/520 |
| 5,237,979 | 8/1993 | Hyodo et al. | 123/516 |
| 5,261,439 | 11/1993 | Harris | 123/516 |
| 5,359,978 | 11/1994 | Kidokoro et al. | 123/520 |
| 5,601,065 | 2/1997 | Tamura et al. | 123/516 |

FOREIGN PATENT DOCUMENTS 60-199727 10/1985 Japan .

*Primary Examiner*—Thomas N. Moulis

*Attorney, Agent, or Firm*—Frishauf, Holtz, Goodman, Langer & Chick

[57] ABSTRACT

An evaporative emission control system for an internal combustion engine includes an evaporative fuel passage extending between the intake system and the fuel tank of the engine. A control valve is arranged across the evaporative fuel passage, for opening and closing the evaporative fuel passage. The opening of the control valve is controlled such that the interior of the fuel tank is under negative pressure during operation and stoppage of the engine.

32 Claims, 22 Drawing Sheets

EVAPORATIVE EMISSION CONTROL SYSTEM FOR INTERNAL COMBUSTION ENGINES

BACKGROUND OF THE INVENTION

1. Field of the Invention

This invention relates to an evaporative emission control system for internal combustion engines, and more particularly to an evaporative emission control system of this kind, which has an evaporative fuel passage extending between the fuel tank and the intake system of the engine, and functions to prevent evaporative fuel generated in the fuel tank from emitting into the air when the filler cap of the fuel tank is removed for refueling.

2. Prior Art

Conventional evaporative emission control systems for internal combustion engines for vehicles are generally constructed such that to prevent evaporative fuel generated in the fuel tank from emitting into the air, the fuel tank is connected via a canister of the system to the intake pipe of the engine so that evaporative fuel generated in the fuel tank is adsorbed by the canister during stoppage of the engine and desorbed by the canister to be supplied to the engine for combustion during operation of the engine.

According to the conventional systems, when load on the engine is so large that the temperature of fuel in the fuel tank rises, followed by the engine being stopped, such as when the vehicle is running on an ascending slope, when the outside air temperature largely rises during stoppage of the engine, or when the vehicle is parked over a long time period, the amount of evaporative fuel generated in the fuel tank increases to an amount which cannot be adsorbed by the canister alone, resulting in emission of part of the evaporative fuel into the air. Further, when the pressure within the fuel tank is higher than atmospheric pressure due to an increase in the amount of evaporative fuel in the fuel tank, if the filler cap of the fuel tank is removed for refueling, part of the evaporative fuel in the fuel tank is emitted into the air.

To prevent such undesirable emission of evaporative fuel, it has been proposed, for example, from Japanese Laid-Open Patent Publication (Kokai) No. 60-199727, to provide an on-off valve arranged across an evaporative fuel passage extending between the fuel tank and the canister, for opening and closing the evaporative fuel passage, and a cover pivotably mounted on the vehicle chassis in a fashion covering the filler cap mounted on an oil inlet of the fuel tank, the on-off valve being interlocked with the cover such that when the cover is opened such as at refueling, the on-off valve is opened, to thereby allow evaporative fuel to be supplied from the fuel tank to the canister even during refueling, so as to reduce the amount of evaporative fuel emitted into the air from the fuel tank via the oil inlet.

According to the prior art, however, the canister cannot always be held under negative pressure during stoppage of the engine, such as at refueling, and accordingly evaporative fuel in the fuel tank is not drawn into the canister, resulting in that evaporative fuel in the fuel tank cannot be adsorbed by the canister. One way to cope with this inconvenience would be to increase the size of the canister and hence the capacity thereof for adsorbing evaporative fuel during operation of the engine. However, the increased size of the canister can unfavorably necessitate increasing a space required for accommodation of the canister.

SUMMARY OF THE INVENTION

It is a first object of the invention to provide an evaporative emission control system for internal combustion engines, which is capable of preventing evaporative fuel in the fuel tank from emitting into the air when the filler cap of the fuel tank is removed for refueling.

It is a second object of the invention to provide an evaporative emission control system for internal combustion engines, which is capable of positively preventing evaporative fuel in the fuel tank from emitting into the air during refueling, without increasing the size of the system.

It is a third object of the invention to provide an evaporative emission control system for internal combustion engines, which is capable of carrying out negative pressurization of the fuel tank in a manner taking into account deterioration of the fuel in the fuel tank, to thereby minimize the deterioration of fuel in the fuel tank while the fuel tank is held in a negatively pressurized state.

It is a fourth object of the invention to provide an evaporative emission control system for internal combustion engines, which is capable of carrying out negative pressurization of the fuel tank to the maximum possible extent while avoiding inappropriate or unnecessary negative pressurization of the fuel tank even when the tank internal pressure sensor and/or the fuel temperature sensor is defective.

It is a fifth object of the invention to provide an evaporative emission control system for internal combustion engines, which is capable of preventing liquefied fuel from entering the intake pipe of the engine via the evaporative fuel passage, to thereby prevent a drastic change in the air-fuel ratio of a mixture supplied to the engine.

To attain the first object, the present invention provides an evaporative emission control system for an internal combustion engine having an intake system and a fuel tank, comprising:

- an evaporative fuel passage extending between the intake system and the fuel tank;
- a control valve arranged across the evaporative fuel passage, for opening and closing the evaporative fuel passage; and
- control means for controlling opening of the control valve such that an interior of the fuel tank is under negative pressure during operation and stoppage of the engine.

Preferably, the evaporative emission control system includes a temperature sensor for detecting temperature of fuel within the fuel tank, and a pressure sensor for detecting pressure within the fuel tank, and wherein the control means determines a desired value of the pressure within the fuel tank according to the temperature of fuel detected by the temperature sensor, and controls the control valve such that the pressure within the fuel tank becomes equal to the determined desired value.

More preferably, the evaporative emission control system includes a temperature sensor for detecting temperature of fuel within the fuel tank, and a pressure sensor for detecting pressure within the fuel tank, and wherein the control means determines a desired value of the pressure within the fuel tank according to the temperature of fuel detected by the temperature sensor and a highest possible outside air temperature set beforehand, and controls the control valve such that the pressure within the fuel tank becomes equal to the determined desired value.

Further preferably, the control means determines the desired value of the pressure within the fuel tank, based on a first increase amount of the pressure within the fuel tank due to a heat held by the fuel within the fuel tank, and a second increase amount of the pressure within the fuel tank to be obtained when the temperature of the fuel rises to the highest possible outside air temperature.

Preferably, the control means sets the desired value of the pressure within the fuel tank to such a value that the pressure within the fuel tank is excessively negatively pressurized to a higher degree than required in view of the first increase amount and the second increase amount, so as to maintain negative pressure within the fuel tank even after the engine is stopped.

Advantageously, the engine is an internal combustion engine for an automotive vehicle, the evaporative emission control system including setting means for setting the highest possible outside air temperature, the setting means setting the highest possible outside air temperature depending on an ambient temperature circumstance of the vehicle.

To attain the second object, the present invention provides an evaporative emission control system for an internal combustion engine having a fuel tank, comprising:

residual fuel amount-detecting means for detecting a residual fuel amount within the fuel tank; and negative pressure control means for controlling pressure within the fuel tank to a negative pressure value;

and wherein the negative pressure control means controls the pressure within the fuel tank to a higher value as the residual fuel amount detected by the residual fuel amount-detecting means is larger.

Preferably, the evaporative emission control system includes fuel temperature-estimating means for estimating an increase amount of temperature of fuel within the fuel tank according to the detected residual fuel amount, and tank internal pressure increase amount-estimating means for estimating an increase amount of the pressure within the fuel tank according to the estimated increase amount of the temperature of the fuel, and wherein the negative pressure control means controls the pressure within the fuel tank to a higher value as the estimated increase amount of the pressure within the fuel tank is larger.

More preferably, the evaporative emission control system includes fuel temperature-detecting means for detecting temperature of the fuel within the fuel tank, and pressure-detecting means for detecting the pressure within the fuel tank, and wherein the negative pressure control means determines a desired value of the pressure within the fuel tank, based on the detected fuel temperature, the detected pressure within the fuel tank, and the estimated pressure increase amount, and controls the pressure within the fuel tank so as to become equal to the desired value.

To attain the second object, the present invention also provides an evaporative fuel control system for an internal combustion engine having a fuel tank, comprising:

residual fuel amount-detecting means for detecting a residual fuel amount within the fuel tank;

pressure-detecting means for detecting pressure within the fuel tank;

residual fuel amount-estimating means for estimating the residual fuel amount within the fuel tank; and negative pressure control means for controlling the pressure within the fuel tank to a negative pressure value;

and wherein the residual fuel amount-estimating means estimates the residual fuel amount, based on a rate of change in the pressure within the fuel tank occurring during operation of the negative pressure control means, and the negative pressure control means controls the pressure within the fuel tank to a higher value as the estimated residual fuel amount is larger.

Preferably, the evaporative emission control system includes an evaporative fuel passage extending between the intake system and the fuel tank, and a control valve arranged across the evaporative fuel passage, for opening and closing the evaporative fuel passage, the negative pressure control means being formed of the evaporative fuel passage and the control valve.

To attain the third object, the present invention provides an evaporative emission control system for an internal combustion engine having an intake system and a fuel tank, comprising:

an evaporative fuel passage extending between the intake system and the fuel tank;

a control valve arranged across the evaporative fuel passage, for opening and closing the evaporative fuel passage;

increase amount-calculating means for calculating an increase amount of pressure within the fuel tank obtained when the control valve has shifted from an open state to a closed value; and control means for determining a desired value of the pressure within the fuel tank according to the increase amount calculated by the increase amount-calculating means, and controlling opening of the control valve such that the pressure within the fuel tank becomes equal to the determined desired value.

Preferably, the evaporative emission control system includes temperature-detecting means for detecting temperature of fuel within the fuel tank, and wherein the control means determines the desired value of the pressure within the fuel tank according to the increase amount calculated by the increase amount-calculating means and the fuel temperature detected by the temperature-detecting means.

More preferably, the increase amount-calculating means calculates the increase amount of the pressure within the fuel tank a plurality of times to calculate an average value of the increase amount, the control means determining the desired value of the pressure within the fuel tank according to the calculated average value.

Preferably, the control means sets the desired value of the pressure within the fuel tank to a higher value as the increase amount calculated by the increase amount-calculating means is smaller.

To attain the fourth object, the present invention provides an evaporative emission control system for an internal combustion engine having an intake system and a fuel tank, comprising:

an evaporative fuel passage extending between the intake system and the fuel tank;

a control valve arranged across the evaporative fuel passage, for opening and closing the evaporative fuel passage;

a temperature sensor for detecting temperature of fuel within the fuel tank;

an intake system internal pressure sensor for detecting pressure within the intake system;

a tank internal pressure sensor for detecting pressure within the fuel tank; and control means operable when the tank internal pressure sensor is defective, for opening the control valve if the pressure within the intake system detected by the intake system internal pressure sensor is lower than a desired value of the pressure within the fuel tank determined according to the temperature of fuel detected by the temperature sensor.

Preferably, the control means controls the control valve such that the pressure within the fuel tank becomes equal to the desired value when the tank internal pressure sensor is not defective.

To attain the fourth object, the present invention also provides an evaporative emission control system for an internal combustion engine having an intake system and a fuel tank, comprising:

an evaporative fuel passage extending between the intake system and the fuel tank;

a control valve arranged across the evaporative fuel passage, for opening and closing the evaporative fuel passage;

a temperature sensor for detecting temperature of fuel within the fuel tank;

an intake system internal pressure sensor for detecting pressure within the intake system;

a tank internal pressure sensor for detecting pressure within the fuel tank; and control means operable when the temperature sensor is defective, for controlling the control valve such that the pressure within the fuel tank becomes equal to a predetermined value.

Preferably, the control means closes the control valve when the pressure within the intake system detected by the intake system internal pressure sensor is higher than the predetermined value.

Also preferably, the control means controls the control valve such that the pressure within the fuel tank becomes equal to the predetermined value when the pressure within the intake system detected by the intake system internal pressure sensor is lower than the predetermined value.

Preferably, the control means controls the control valve such that the pressure within the fuel tank becomes equal to a desired value determined according to the fuel temperature detected by the temperature sensor when the temperature sensor is not defective.

To attain the fifth object, the present invention provides an evaporative emission control system for an internal combustion engine having an intake system and a fuel tank, comprising:

an evaporative fuel passage extending between the intake system and the fuel tank;

a control valve arranged across the evaporative fuel passage, for opening and closing the evaporative fuel passage; and gas-liquid separator means arranged across the evaporative fuel passage.

Preferably, the evaporative emission control system includes a first pressure sensor for detecting pressure within the intake system, a second pressure sensor for detecting pressure within the fuel tank, and wherein the control means opens the control valve over a predetermined time period when a value of the pressure within the intake system detected by the first pressure sensor is higher than a value of the pressure within the fuel tank detected by the second pressure sensor.

More preferably, the predetermined time period is determined based on a ratio of the pressure value within the intake system to the pressure value within the fuel tank.

Further preferably, the predetermined time period is set to a smaller value as the ratio of the pressure value within the intake system to the pressure value within the fuel tank increases within a range between first and second predetermined values, the second predetermined value being larger than the first predetermined value.

The above and other objects, features, and advantages of the invention will be more apparent from the following detailed description taken in conjunction with the accompanying drawings.

BRIEF DESCRIPTION OF THE DRAWINGS

FIG. 8B shows a ΔPte table which is used at a step S12 in FIG. 7;

FIG. 8C is a graph showing the relationship between outside air temperature TA and fuel temperature Tg with the lapse of time;

DETAILED DESCRIPTION

The invention will now be described in detail with reference to the drawings showing embodiments thereof.

Figure 1:
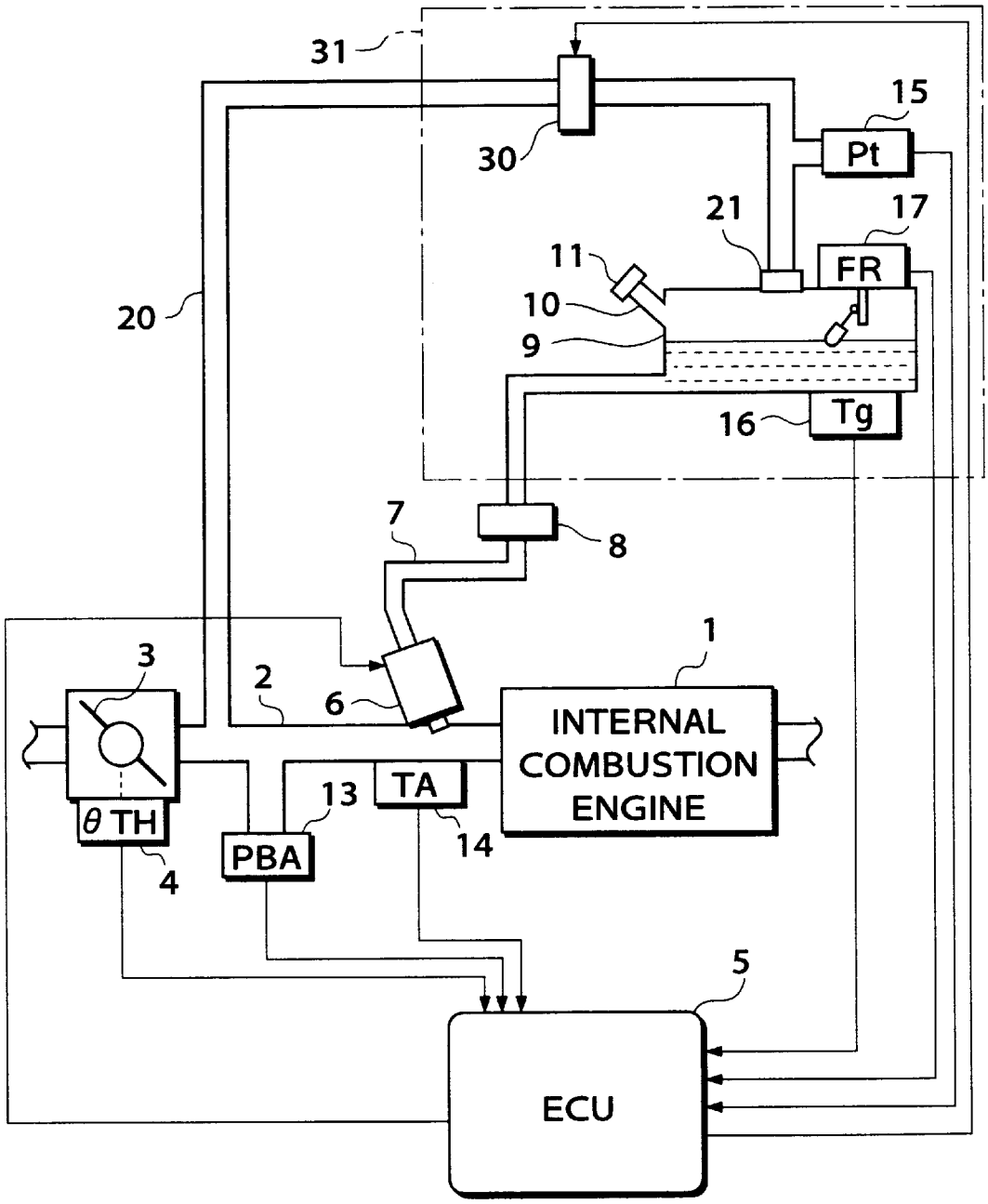
FIG. 1 is a block diagram schematically showing the arrangement of an internal combustion engine and an evaporative emission control system therefor, according to a first embodiment of the invention.

Referring first to FIG. 1, there is illustrated the arrangement of an internal combustion engine and an evaporative emission control system therefor, according to a first embodiment of the invention.

In the figure, reference numeral 1 designates an internal combustion engine (hereinafter simply referred to as "the engine") having four cylinders, not shown, for instance. Arranged in an intake pipe 2 of the engine is a throttle valve 3. A throttle valve opening (θTH) sensor 4 is connected to the throttle valve 3, for generating an electric signal indicative of the sensed throttle valve opening θTH to an electronic control unit (hereinafter referred to as "the ECU") 5.

Fuel injection valves 6, only one of which is shown, are each provided for each cylinder and arranged in the intake pipe 2 at a location intermediate between the engine 1 and the throttle valve 3 and slightly upstream of an intake valve, not shown. The fuel injection valves 6 are connected to a fuel tank 9, which has a hermetically sealed structure, via a fuel supply pipe 7 with a fuel pump 8 arranged thereacross. The fuel tank 9 has an oil inlet 10 for refueling, which is provided with a filler cap 11 mounted thereon.

The fuel injection valves 6 are electrically connected to the ECU 5 to have their valve opening timing controlled by signals therefrom.

An intake pipe absolute pressure (PBA) sensor 13 and an intake air temperature (TA) sensor 14 are inserted into the intake pipe 2 at locations downstream of the throttle valve 3. The PBA sensor 13 detects absolute pressure PBA within the intake pipe 2, and the TA sensor 14 detects intake air temperature TA as outside air temperature. Inserted into the fuel tank 9 are a tank internal pressure (Pt) sensor 15 for detecting pressure (absolute pressure) Pt within the fuel tank 9 (hereinafter referred to as "the tank internal pressure"), and a fuel temperature (Tg) sensor 16 for detecting temperature Tg of fuel in the fuel tank 9. Signals indicative of the detected values thereof are supplied to the ECU 5.

Next, an essential part 31 of the evaporative emission control system will be described, which is comprised of the fuel tank 9, an evaporative fuel passage 20, etc.

The fuel tank 9 is connected through the evaporative fuel passage 20 to the intake pipe 2 at a location downstream of the throttle valve 3. The evaporative fuel passage 20 has a tank pressure control valve 30 arranged thereacross, for opening and closing the passage 20. The control valve 30 is an electromagnetic valve which controls the flow rate of evaporative fuel generated in the fuel tank 9 by changing the on-off duty ratio of a control signal supplied from the ECU 5 which controls the operation of the control valve 30. Alternatively, the control valve 30 may be formed by an electromagnetic valve which has its opening linearly changed.

Provided in the fuel tank 9 is a cut-off valve 21 which is arranged at an end of the evaporative fuel passage 20 opening into the fuel tank 9. The cut-off valve 21 is a float valve which is closed when the fuel tank 9 is fully charged or the tilt thereof is increased.

The ECU 5 is comprised of an input circuit having the functions of shaping the waveforms of input signals from various sensors, shifting the voltage levels of sensor output signals to a predetermined level, converting analog signals from analog-output sensors to digital signals, and so fourth, a central Processing unit (hereinafter referred to as "the CPU"), a memory circuit storing various operational Programs which are executed by the CPU and for storing results of calculations therefrom, etc., and an output circuit which delivers driving signals to the fuel injection valves 6, the control value 30, etc.

The CPU of the ECU 5 operates in response to the above-mentioned signals from the sensors such as the θTH sensor 4 and the PBA sensor 13, to control an amount of fuel supplied to the engine 1, etc., and determines the opening of the control valve 30 in response to output signals from the fuel temperature sensor 16, the Pt sensor 15, etc.

Figure 2:
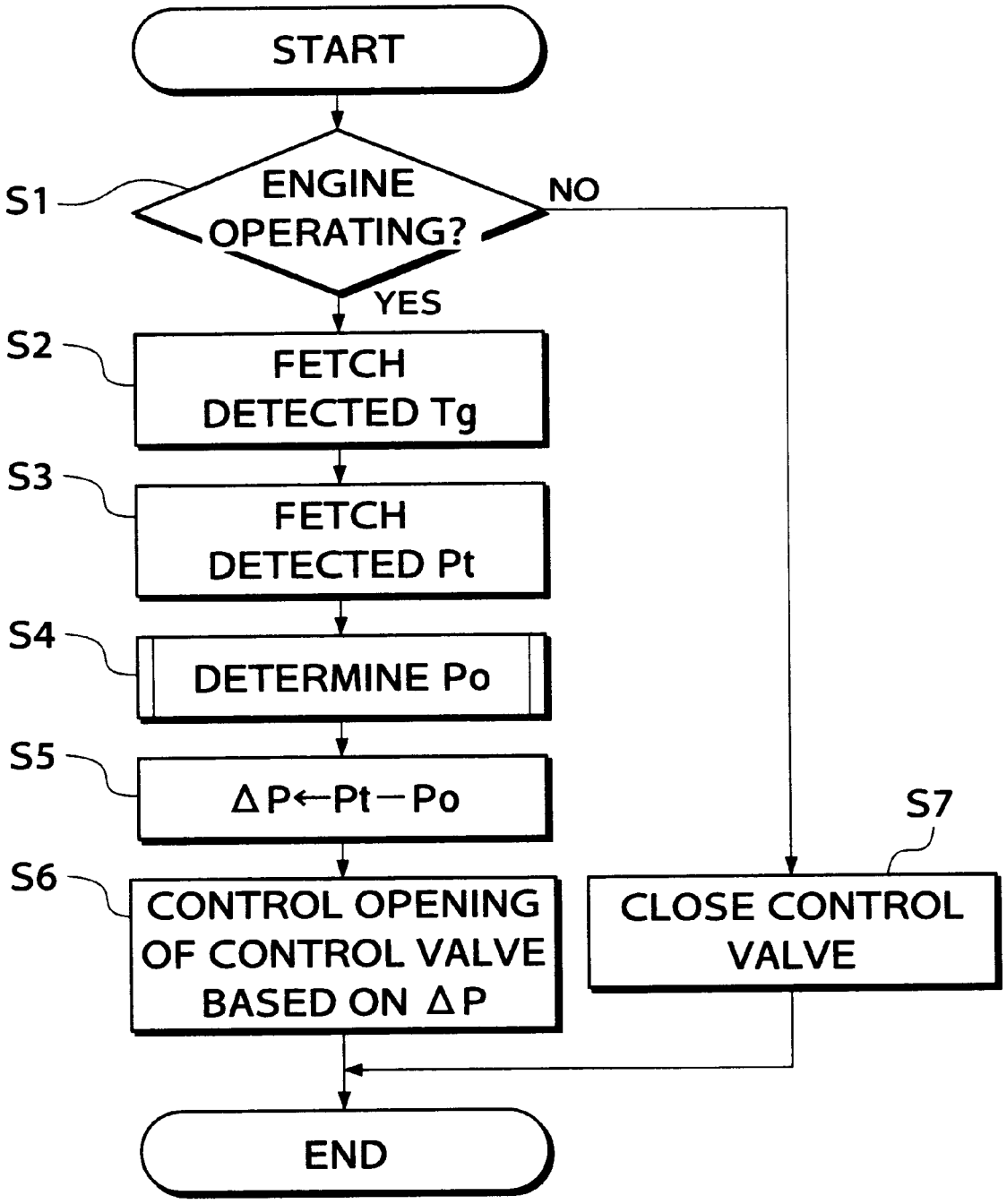
FIG. 2 is a flowchart showing a routine for carrying out an evaporative emission control process according to the first embodiment.

FIG. 2 shows a routine for carrying out an evaporative emission control process according to the first embodiment, which is executed at predetermined time intervals (e.g. 100 msec).

First, at a step S1, it is determined whether or not the engine 1 is operating, e.g. by detecting cranking of the engine 1. If the engine is operating, a value of the fuel temperature Tg within the fuel tank 9 detected by the fuel temperature sensor 16 is fetched at a step S2, and a value of the tank internal pressure Pt detected by the Pt sensor 15 is fetched at a step S3. Further, at a step S4, a desired pressure value (absolute pressure) Po (mmHg) within the fuel tank 9 is determined according to a manner of setting the desired pressure value Po, described hereinafter. The desired pressure value Po is set to such a negative value that the interior of the fuel tank 9 is excessively negatively pressurized to a higher degree than required, in view of an expected increase in the tank internal pressure so as to maintain negative pressure within the fuel tank 9 even after the engine 1 is stopped.

Such an expected increase in the tank internal pressure Pt is caused by the following factors: That is, the fuel contains ingredients which evaporate at temperatures lower than the fuel temperature, due to a heat held by the fuel at the fuel temperature, and part of the fuel evaporates with a rise in the fuel temperature caused by elevation of the outside air temperature TA.

Then, a difference ΔP between the tank internal pressure Pt and the desired pressure value Po is calculated at a step S5, and the opening of the control valve 30 is controlled such that the difference ΔP becomes equal to 0 at a step S6, followed by terminating the present routine.

If it is determined at the step 1 that the engine 1 is not operating or in stoppage, the control valve 30 is closed by the CPU of the ECU 5 at a step S7 so as to maintain negative pressure within the fuel tank 9, which has been controlled to the desired pressure value Po, followed by terminating the present routine.

With the above described construction and control of the evaporative emission control system, when the engine 1 is operating, the opening of the control valve 30 is controlled to introduce the negative pressure in the intake system 2 into the fuel tank 9, to thereby control and hold the tank internal pressure Pt to and at the desired pressure value Po. As a result, the fuel tank 9 is held in the negatively pressurized state not only during operation of the engine 1 but also during stoppage of the same, whereby it is possible to prevent evaporative fuel in the fuel tank 9 from emitting into the air even if the filler cap 11 is removed for refueling.

Next, description will be made of a manner of setting the desired pressure value Po within the fuel tank 9 with reference to FIG. 3, which is executed at the step S4 in FIG. 2.

Figure 3:
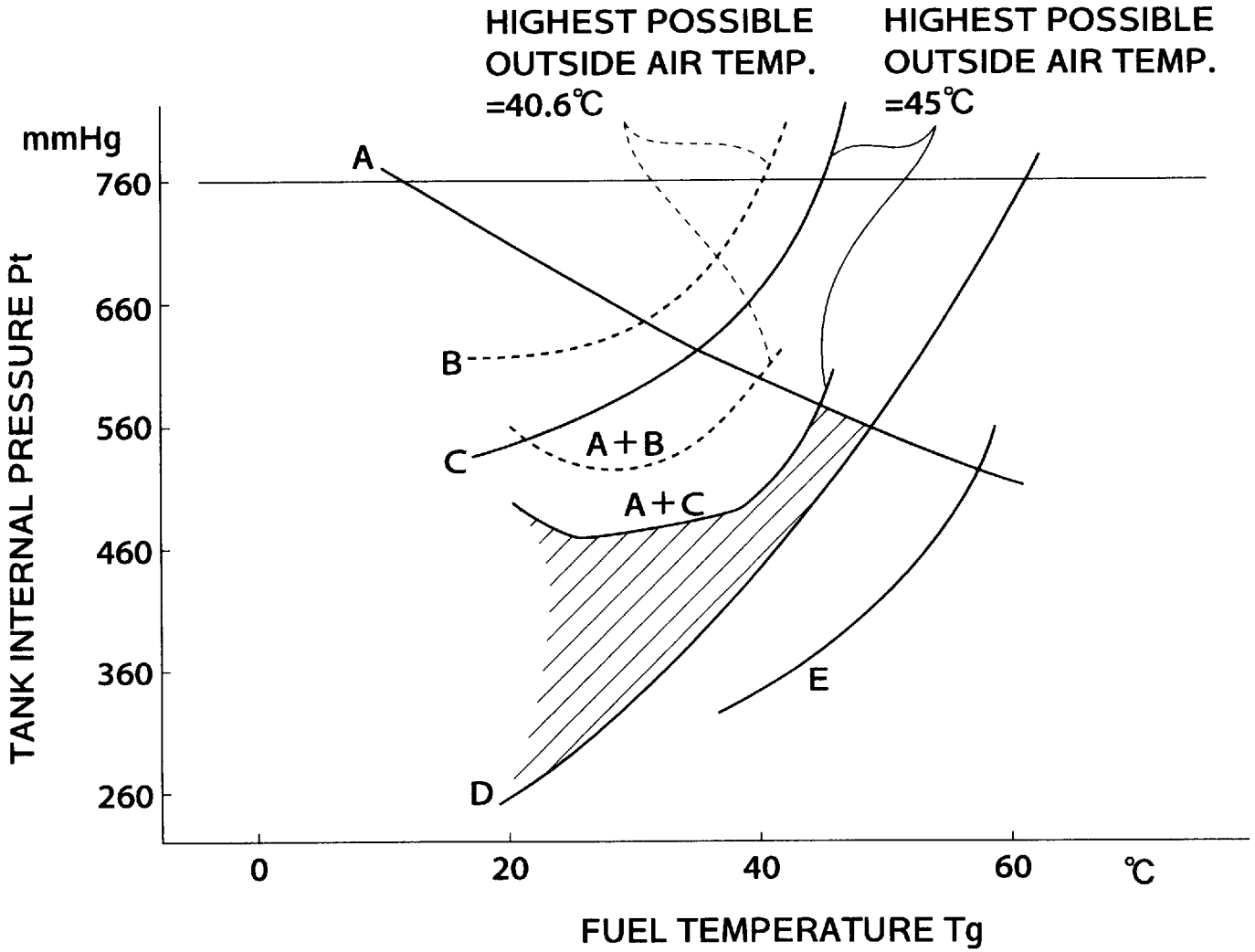
FIG. 3 is a graph useful in explaining a manner of determining a desired pressure value Po within a fuel tank appearing in FIG. 1.

Pressure values to which the desired pressure value Po is to be set, are stored in the memory circuit as a map within a range shown in FIG. 3.

In the figure, the abscissa indicates the fuel temperature Tg (°C.) within the fuel tank 9, and the ordinate the tank internal pressure Pt (mmHg). The tank internal pressure Pt is shown in the absolute pressure value, and a lower portion of the ordinate indicates a lower pressure value.

Next, curves A, B, A+B, C, A+C, D, and E will be described hereinbelow.

The curve A indicates an upper limit value of the desired pressure value Po to which the interior of the fuel tank 9 can be excessively negatively pressurized to a higher degree than required during traveling of a vehicle in which the engine 1 is installed, such that the negative pressure within the fuel tank 9 is held even after the engine 1 is stopped when the negative pressurization of the fuel tank 9 is terminated. That is, the upper limit value of the desired pressure value Po indicated by the curve A is a value to or below which the desired pressure value Po is to be set in view of an increase in the tank internal pressure Pt due to evaporation of the ingredients of the fuel, which evaporate at temperatures lower than the detected fuel temperature Tg, due to a heat held by the fuel at the fuel temperature Tg within the fuel tank 9, immediately after the engine 1 is stopped. The opening of the control valve 30 is controlled such that the tank internal pressure Pt becomes equal to or below the curve A irrespective of the fuel temperature Tg. The curve A is set such that the higher the fuel temperature Tg, the lower the tank internal pressure Pt. That is, the tank internal pressure Pt should be decreased as the fuel temperature Tg is higher.

The curve B indicates an upper limit value of the desired pressure value Po to which the interior of the fuel tank 9 can be excessively negatively pressurized to a higher degree than required during traveling of the vehicle such that the negative pressure within the fuel tank 9 is held even after the engine 1 is stopped when the negative pressurization of the fuel tank 9 is terminated, but the upper limit value of the desired pressure value Po indicated by the curve B is a value to or below which the desired pressure value Po is to be set in view of an increase in the tank internal pressure Pt due to a rise of the outside air temperature TA to a predetermined highest possible temperature 40.6° C. during stoppage or parking of the vehicle and hence a rise of the fuel temperature Tg to 40.6° C. The predetermined highest possible outside air temperature of 40.6° C. is set when the vehicle is designed. The curve B is set such that the higher the fuel temperature Tg, the higher the tank internal pressure Pt.

The curve A+B is a curve which satisfies both of the above-mentioned conditions of the curves A and B. According to the curve A+B, the tank internal pressure Pt assumes the minimum value when the fuel temperature Tg is equal to or close to 25° C. When 40.6° C. is selected as the highest possible outside air temperature, the opening of the control valve 30 is controlled such that the tank internal pressure Pt becomes equal to or below the curve A+B, irrespective of the fuel temperature Tg.

The curve C indicates an upper limit value of the desired pressure value Po which is set under the same conditions as the curve B but on the assumption that the predetermined highest possible outside air temperature is 45° C., which is higher than 40.6° C.

The curve A+C is a curve which satisfies both of the conditions of the curves A and C. When 45° C. is selected as the highest possible outside air temperature, the opening of the control valve 30 is controlled such that the tank internal pressure Pt becomes equal to or below the curve A+C.

The curve D indicates a lower limit value of the pumping force of the fuel pump 8 which delivers fuel from the fuel tank to the engine 1, i.e. the lower limit value of the desired pressure value Po. If the tank internal pressure Pt is below the curve D, the fuel pump 8 cannot pump fuel out of the fuel tank 9, and therefore the desired pressure value Po needs to be set to a value at least equal to or above the curve D. The curve D is set such that the higher the fuel temperature Tg, the higher the tank internal pressure Pt. Further, it should be noted that the lower limit value of the desired pressure value Po depicted by the curve D is always lower than the upper limit value of the desired pressure value Po depicted by the curve A+C.

Lastly, the curve E indicates a limit line at or above which the fuel can preserve its properties as fuel (i.e. a limit line below which fuel or gasoline becomes deteriorated to such a degree that it cannot be used as fuel). If the tank internal pressure Pt lowers below the curve E, the volatile ingredients of the fuel in the fuel tank 9 evaporate, and therefore the fuel cannot maintain its properties as fuel. The curve E is set such that the higher the fuel temperature Tg, the higher the tank internal pressure Pt. It should be noted that the limit line depicted by the curve E is always lower than the lower limit value of the desired pressure value Po depicted by the curve D.

In the present embodiment, as the predetermined highest possible outside air temperature is 45° C. which is the stricter value is selected, i.e. the range satisfying the condition defined by the curve C is employed. Therefore, to hold the fuel tank 9 in the negatively pressurized state even after the engine 1 is stopped when the negative pressurization of the fuel tank 9 is terminated, the desired pressure value Po should be set to such a value as satisfies all the conditions defined by the curves A, C, A+C, D, and E. More specifically, the desired pressure value Po is set to values falling within a range indicated by the shaded portion in FIG. 3 according to the fuel temperature Tg.

According to the present embodiment, the control valve 30 is controlled to introduce the negative pressure within the intake pipe 2 into the fuel tank 9 during operation of the engine 1, whereby the pressure within the fuel tank 9 is controlled to the predetermined desire pressure value Po. Thus, the fuel tank 9 is held under negative pressure even if the outside air temperature rises to 45° C. during stoppage of the engine 1. As a result, evaporative fuel in the fuel tank 9 can be prevented from emitting into the air even when the filler cap 11 is removed for refueling. Further, the interior of the fuel tank 9 is negatively pressurized, which dispenses with the use of a canister. Thus, it is possible to prevent emission of evaporative fuel with a simple construction of the system and at a low cost.

Next, description will be made of a second embodiment of the invention.

Figure 4:
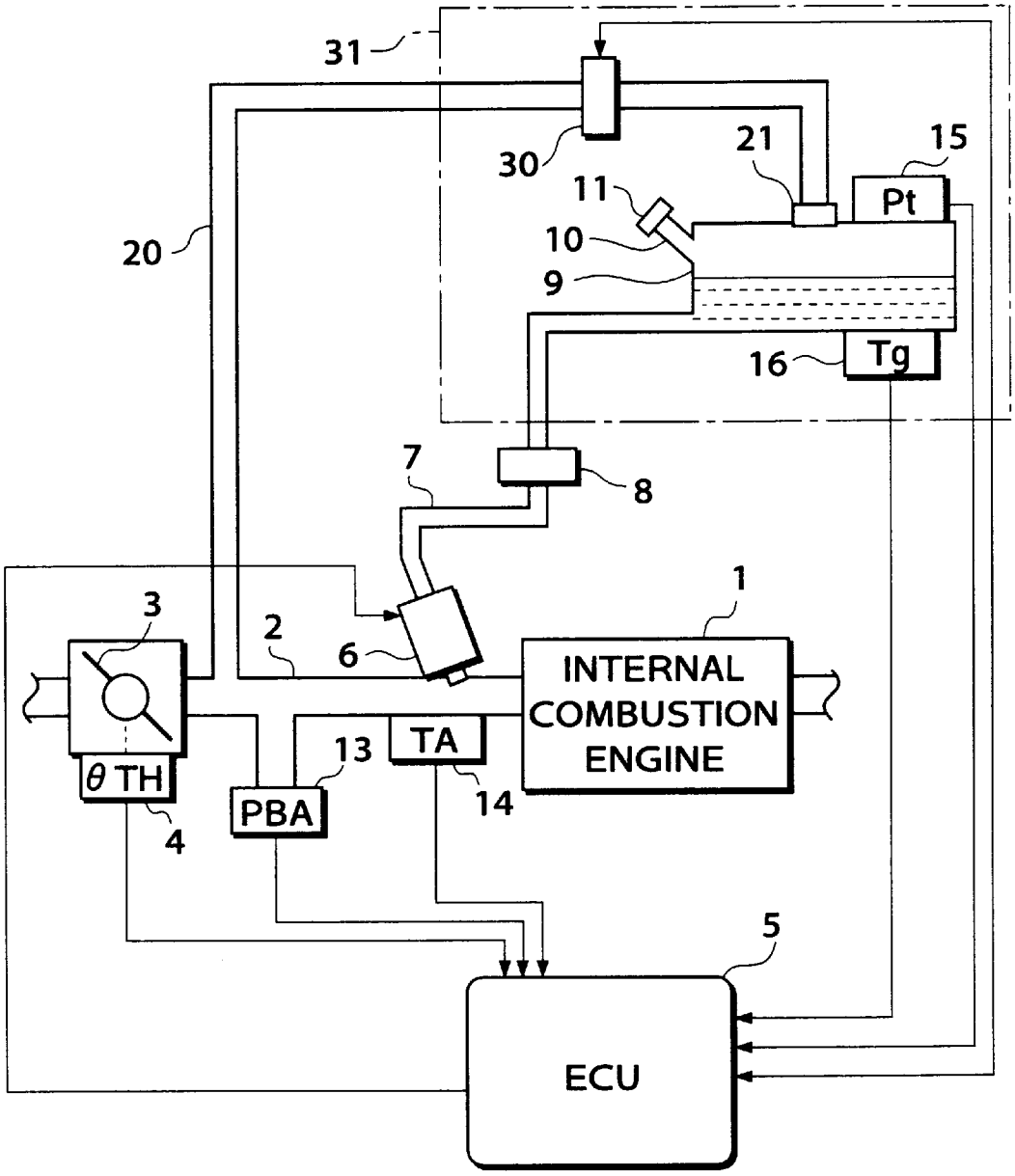
FIG. 4 is a block diagram schematically showing the arrangement of an internal combustion engine and an evaporative emission control system therefor, according to a second embodiment of the invention.

FIG. 4 shows the arrangement of an evaporative emission control system according to the second embodiment. In the present embodiment, the fuel tank 9 is provided with a float-type residual fuel amount (FR) sensor (residual fuel amount-detecting means) 17 for detecting an amount of residual fuel FR within the fuel tank 9, and an electric signal indicative of the sensed residual fuel amount FR is supplied to the ECU 5.

The tank internal pressure (Pt) sensor 15 is inserted into the evaporative fuel passage 20 at a location close to the fuel tank 9, for supplying an electric signal indicative of the sensed tank internal pressure Pt to the ECU 5. Alternatively, the tank internal pressure (Pt) sensor 15 may be directly inserted into the fuel tank 9 as illustrated in FIG. 1. The construction of the other component parts of the evaporative emission control system according to the present embodiment is identical with that of the first embodiment, description of which is omitted.

Figure 5:
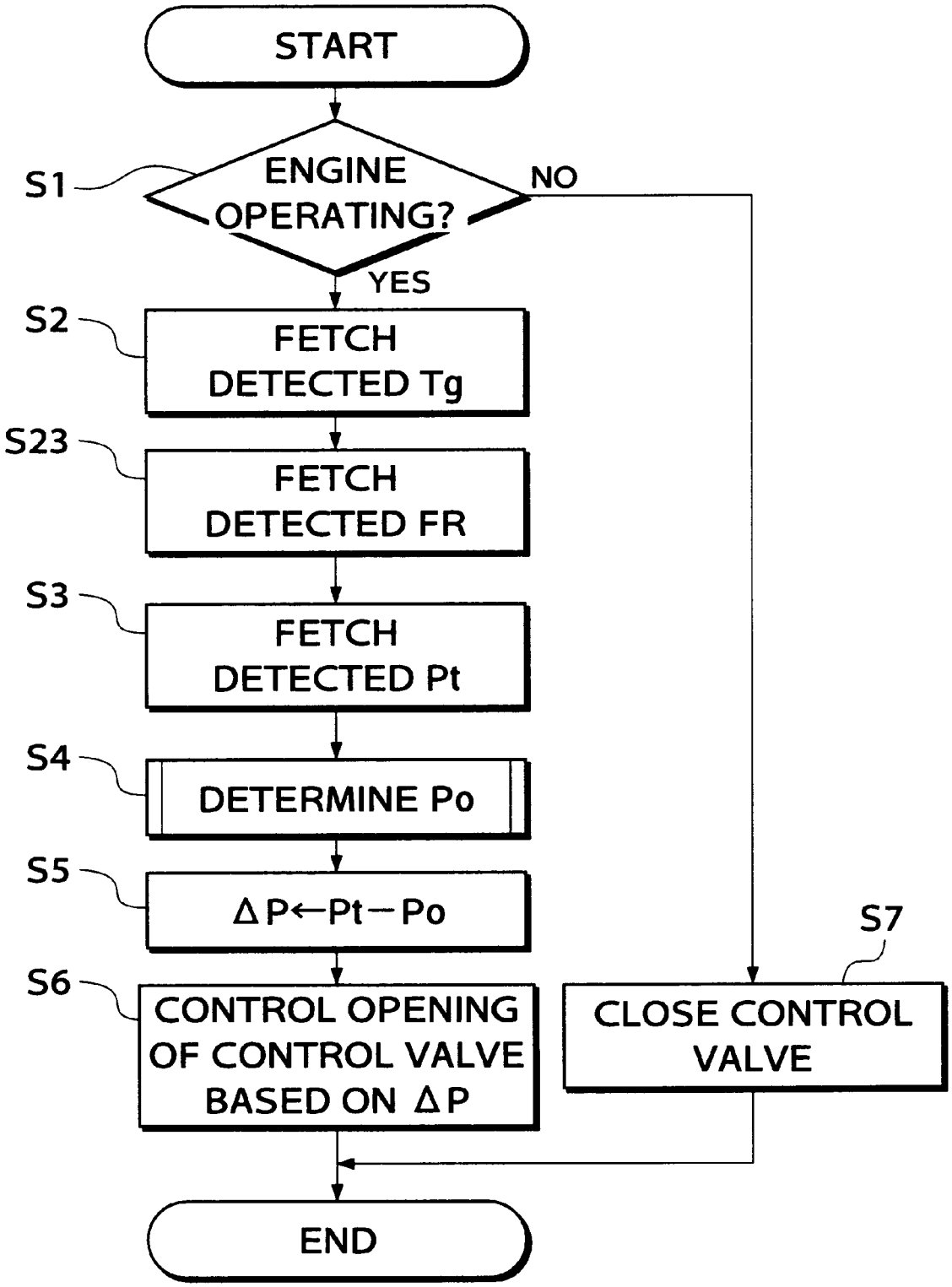
FIG. 5 is a flowchart showing a routine for carrying out an evaporative emission control process according to the second embodiment.

FIG. 5 shows a routine for carrying out an evaporative emission control process according to the second embodiment. In the figure, corresponding steps to those in FIG. 2 are designated by identical step numbers. In the present embodiment, the pressure within the fuel tank 9 is controlled based on the residual fuel amount FR detected by the FR sensor 17 in addition to the detected fuel temperature Tg.

At the step S2, a value of the fuel temperature Tg within the fuel tank 9 detected by the fuel temperature sensor 16 is fetched, similarly to the first embodiment, and then at a step S23 a value of the residual fuel amount FR detected by the residual fuel amount sensor 17 is fetched, followed by the Program Proceeding to the step S4. The other steps are identical with those in FIG. 2 of the first embodiment, description thereof being omitted.

Figure 6:
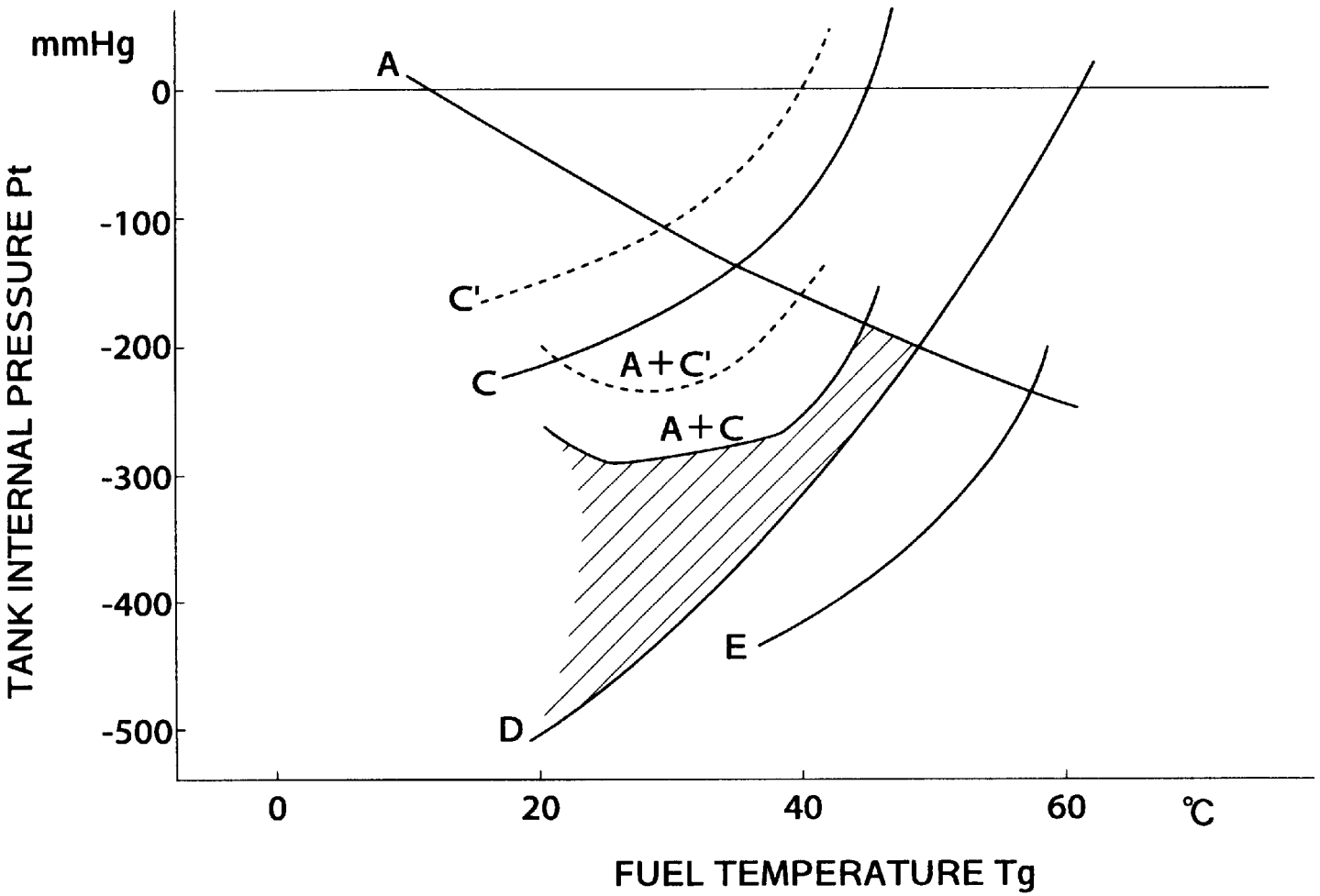
FIG. 6 is a graph useful in explaining a manner of determining the desired pressure value Po according to the second embodiment.

FIG. 6 shows how the desired pressure value Po within the fuel tank 9 is set according to the second embodiment. The Po value is set in a manner similar to the above described manner of the first embodiment, and therefore only a portion of the manner different from that of the first embodiment will be described hereinbelow.

The present embodiment contemplates the fact that the degree of influence of the outside air temperature TA on the fuel temperature Tg changes depending on the residual fuel amount FR in the fuel tank 9. That is, according to the present embodiment, the desired pressure value Po is set according to the residual fuel amount FR in addition to the fuel temperature Tg. FIG. 8C shows changes in the fuel temperature Tg with changes in the outside air temperature TA indicated by the solid line. As is understood from the figure, when the residual fuel amount FR is small, the change in the outside air temperature TA is directly reflected on the change in the fuel temperature Tg with a predetermined time lag as indicated by the broken line. On the other hand, when the residual fuel amount FR is large, the change in the outside air temperature TA is reflected on the change in the Tg value in a considerably smoothed manner as indicated by the dot-dash line.

The curve C in FIG. 6 indicates the upper limit value of the Po value, similar to the curve C shown in FIG. 3, which is obtained when the change in the outside air temperature TA is almost directly reflected on the fuel temperature Tg. On the other hand, if the residual fuel amount FR is large, the upper limit value is shifted to a larger value as indicated by a curve C'. Therefore, the desired pressure value Po can be set to a value within a range defined by a curve A+C' and the curve D, which is larger than the shaded range defined by the curves A+C and D in FIG. 3.

Figure 7:
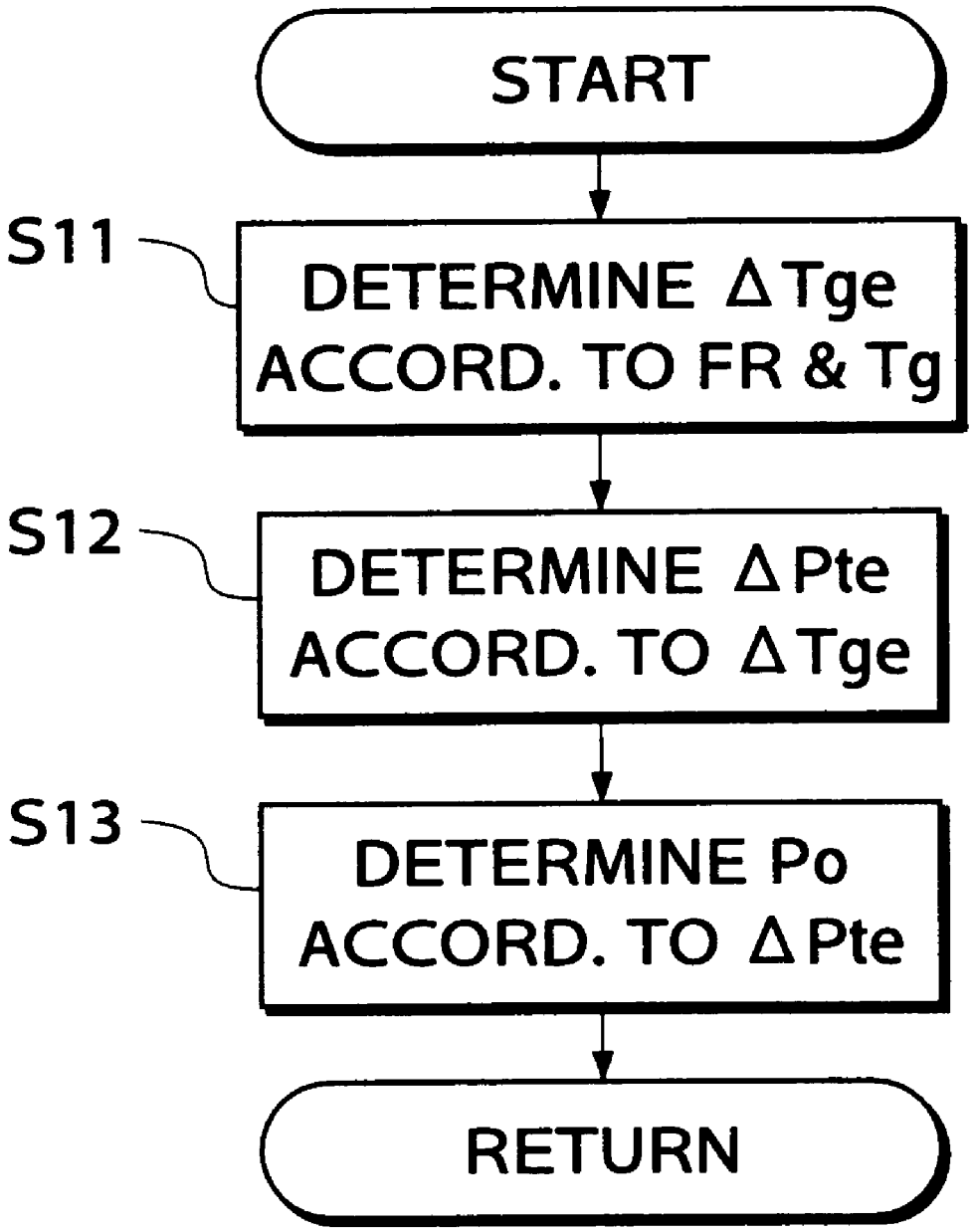
FIG. 7 is a flowchart showing a subroutine for determining the Po value, which is executed at a step S4 in FIG. 5.
Figure 8A:
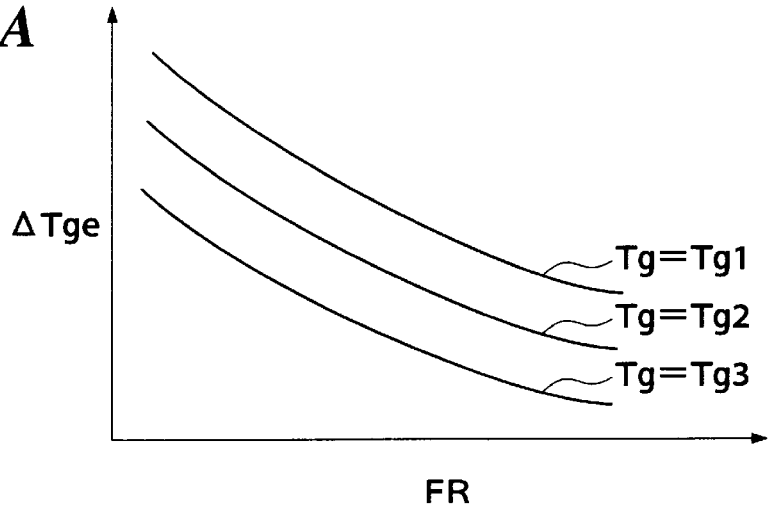
FIG. 8A shows a ΔTge table which is used at a step S11 in FIG. 7.
Figure 8A:
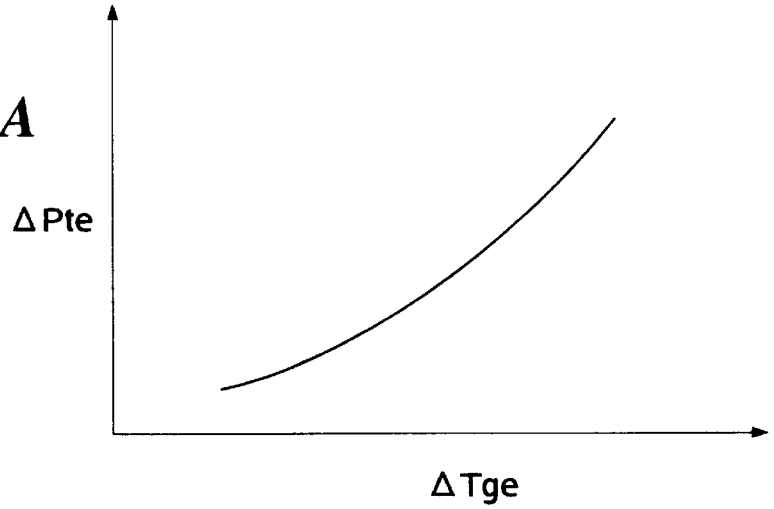
Figure 8A:
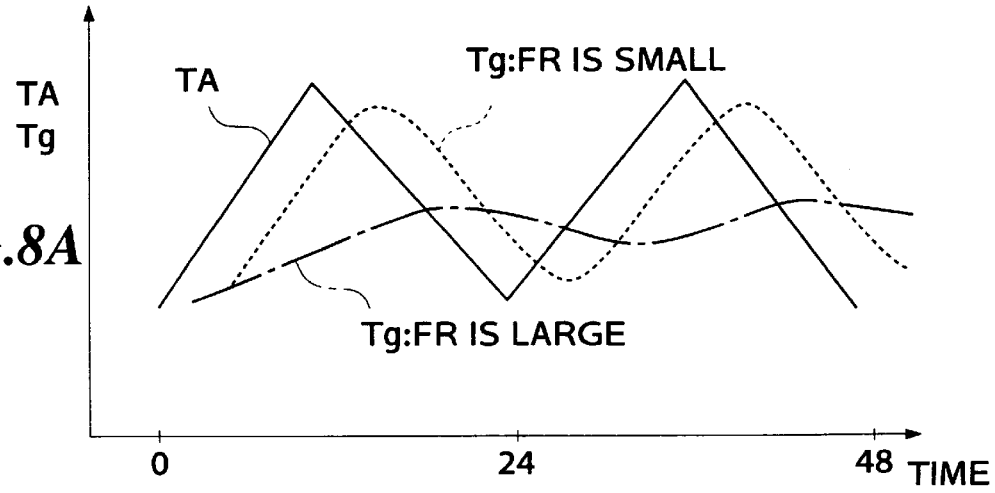

FIG. 7 shows a subroutine for determining the desired pressure value Po with the residual fuel amount FR taken into account, which is executed at the step S4 in FIG. 5. At a step S11, a ΔTge table shown in FIG. 8A is retrieved according to the fuel temperature Tg and the residual fuel amount FR, to thereby determine an estimated amount of increase in the fuel temperature Tg during stoppage of the engine 1 (hereinafter referred to as "the estimated temperature increase amount") ΔTge. The ΔTge table is set with the characteristics of the fuel temperature Tg shown in FIG. 8C, such that the estimated temperature increase amount ΔTge decreases as the residual fuel amount FR at each of predetermined fuel temperature values Tg1, Tg2, and Tg3 (Tg1<Tg2<Tg3) is larger. When the fuel temperature Tg assumes a value other than the predetermined temperature values Tg1 to Tg3, the estimated temperature increase amount ΔTge is calculated by interpolation.

At the following step S12, a ΔPte table shown in FIG. 8B is retrieved according to the estimated temperature increase amount ΔTge, to thereby determine an estimated amount of increase in the tank internal pressure Pt during stoppage of the engine 1 (hereinafter referred to as "the estimated tank internal pressure increase amount") ΔPte. The ΔPte table is set such that the estimated tank internal pressure increase amount ΔPte increases as the estimated temperature increase amount ΔTge is larger.

Then, the desired pressure value Po is determined according to the estimated tank internal pressure increase amount ΔPte such that the conditions described above with reference to FIG. 6 are satisfied. That is, the estimated tank internal pressure increase amount ΔPte is added to the desired pressure value Po obtained from the map of FIG. 3, to thereby determine a value of the Po value. Further, since the estimated tank internal pressure increase amount ΔPte only satisfies the conditions of the curves C and B', the desired pressure value Po is determined so as to also satisfy the conditions of the curves A and C.

Alternatively, in place of adding the ΔPte value to the desired pressure value Po, a plurality of Po maps corresponding to different values of the ΔPte value may be prepared, and a map corresponding to the ΔPte value determined at the step S12 may be selected as the final desired pressure value Po.

As described hereinabove, according to the present embodiment, in addition to the above described effects obtained by the first embodiment, the desired pressure value Po can be controlled to an optimum value depending on the residual fuel amount FR by virtue of the determination of the desired pressure value Po according to the residual fuel amount FR of the fuel tank 9. For example, when the residual fuel amount FR is large, the desired pressure value Po is set to a value larger than a value assumed when the FR value is small, which prevents excessive negative pressurization of the fuel tank, to thereby enable negative pressurization of the fuel tank 9 to be easily carried out in a short time period.

Next, a third embodiment of the invention will be described with reference to FIGS. 9, 10, and 11.

Figure 9:
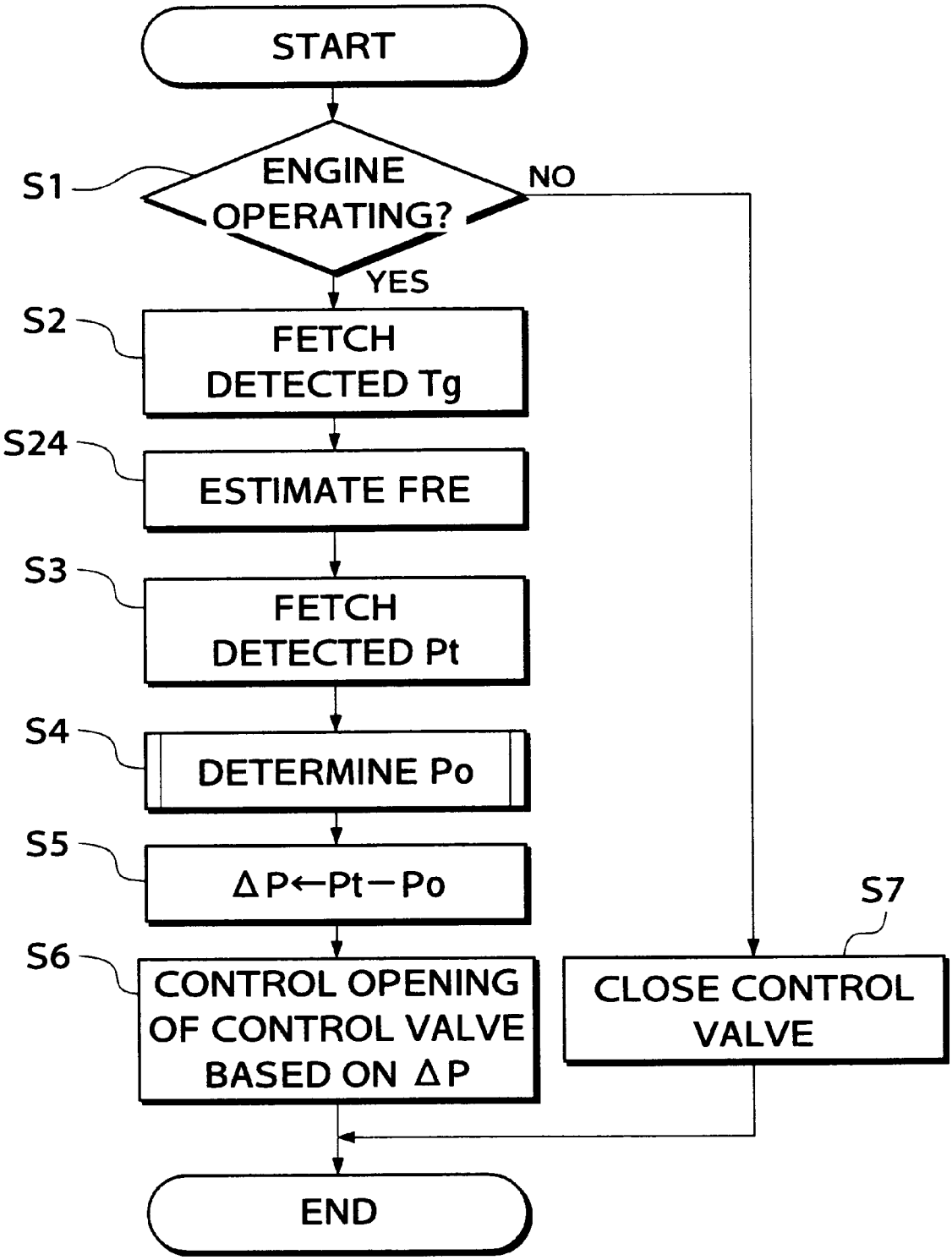
FIG. 9 is a flowchart showing a routine for carrying out an evaporative emission control process according to a third embodiment of the invention.

FIG. 9 shows a routine for carrying out an evaporative emission control process according to the third embodiment. While in the second embodiment described above, the residual fuel amount FR is detected by the float-type residual fuel amount sensor 17, and the desired pressure value Po is set based on the detected FR value, in the third embodiment, the residual fuel amount FR is estimated as an estimated residual amount at a step S24 in FIG. 9, to thereby set the desired pressure value Po based on the estimated value FRE.

Figure 10:
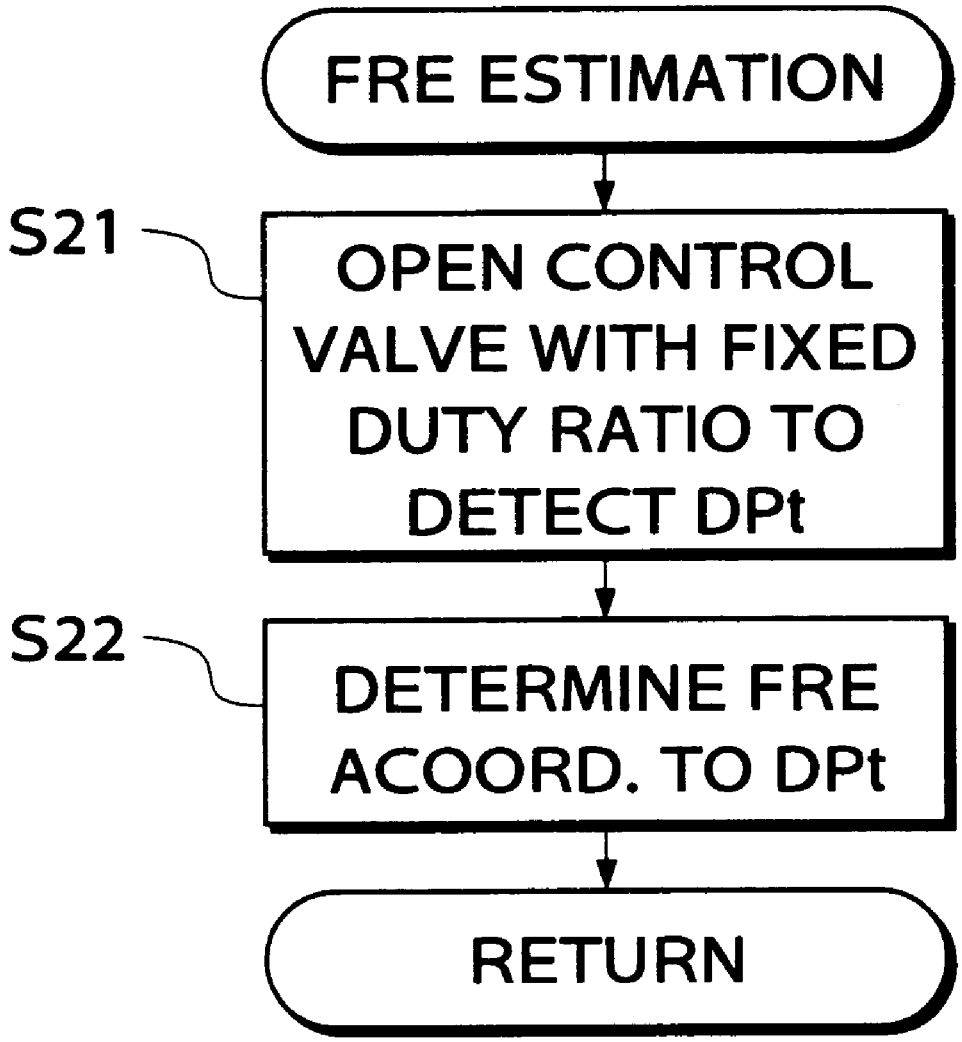
FIG. 10 is a flowchart showing a subroutine for estimating a residual fuel amount FR in the fuel thank, which is executed at a step S24 in FIG. 9.

More specifically, a subroutine of FIG. 10 is carried out for obtaining the estimated residual fuel amount FRE.

Figure 11A:
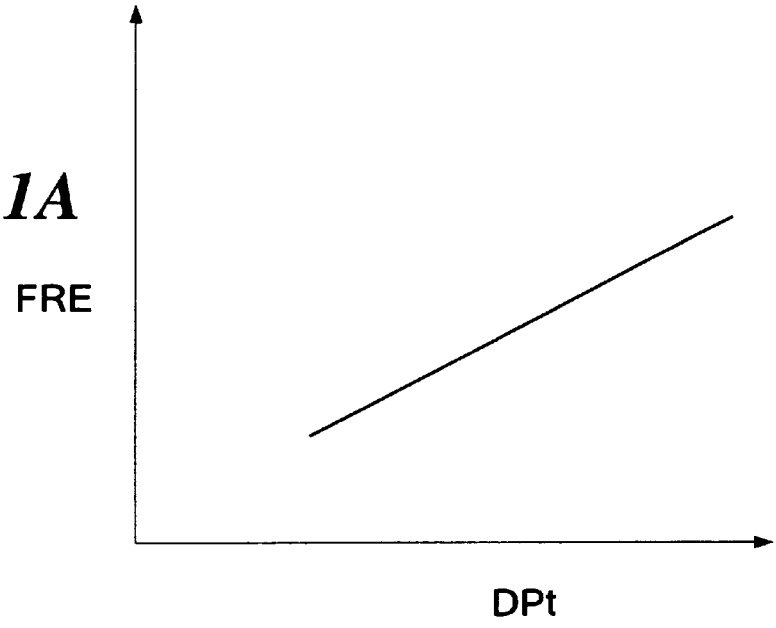
FIG. 11A shows an FRE table which is used at a step S22 in FIG. 10.

First, at a step S21, a control signal having a fixed duty ratio is supplied to the control valve 30 to open the same at a constant opening, to thereby carry out negative pressurization of the fuel tank 9 over a predetermined time period (e.g. 5 sec). Then, a rate of change DPt in the tank internal pressure (difference between a pressure value assumed at the start of negative pressurization and a pressure value assumed after 5 seconds from the start of negative pressurization) is detected. Then, an FRE table shown in FIG. 11A is retrieved according to the rate of change DPt, to thereby determine the estimated residual fuel amount FRE at a step S22.

Figure 11B:
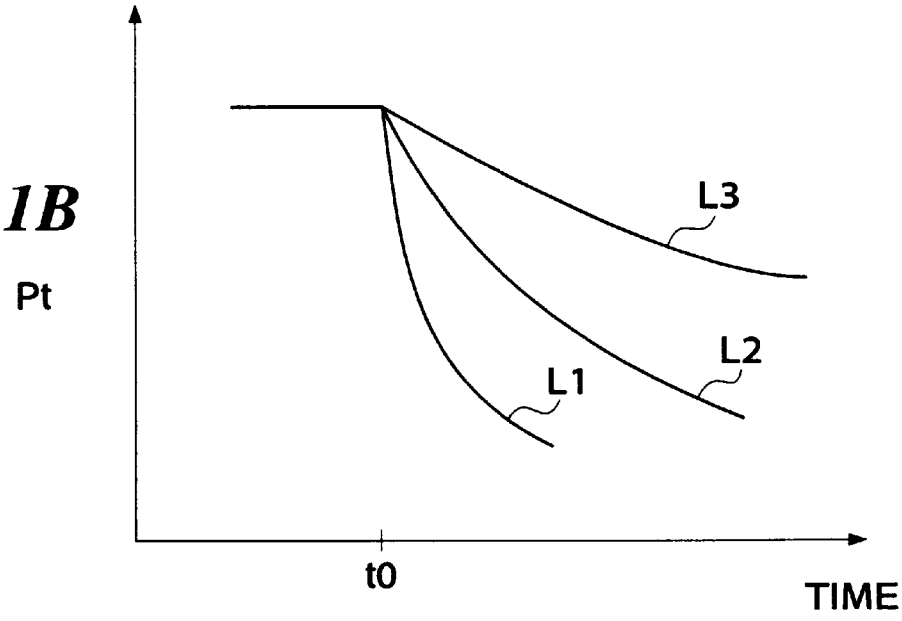
FIG. 11B shows a Pt table for determining tank internal pressure Pt depending on the residual fuel amount FRE.

When the negative pressurization is carried out with the opening of the control valve 30 set to a fixed opening, the rate of change (rate of decrease) in the tank internal pressure Pt tends to increase as the residual fuel amount is larger. More specifically, as shown in FIG. 11B, when negative pressurization is started at a time point t0 with a large residual fuel amount FR contained in the fuel tank 9, the tank internal pressure Pt decreases along a curve L1. On the other hand, as the residual fuel amount FR becomes smaller, the tank internal pressure Pt decreases along a curve L2, and then along a curve L3. Accordingly, the FRE table of FIG. 11A is set such that the estimated residual fuel amount FRE increases as the rate of change DPt is larger.

Then, the desired pressure value Po is determined at the step S4 in FIG. 9, by using the estimated residual fuel amount FRE determined according to the FIG. 10 subroutine. The steps other than the step S24 in FIG. 9 are identical with those in the FIG. 6 subroutine, description thereof being omitted.

According to the present embodiment, in place of the float-type sensor 17 employed in the second embodiment which has an error of detection increased with an increase in the inclination of the vehicle, the desired pressure value Po is set by using the estimated residual fuel amount FRE depending on the rate of change DPt in the tank internal pressure Pt during negative pressurization. As a result, the optimum desired pressure value Po can be set irrespective of the inclination or tilt of the vehicle (i.e. fuel tank), and hence the interior of the fuel tank 9 can be more positively held in the negatively pressurized state even during stoppage of the engine 1.

Alternatively, the second embodiment and the third embodiment may be combined together to determine whether or not the residual fuel amount sensor 17 is abnormal. In this case, if the sensor 17 is normal, the desired pressure value Po is set based on the sensor output value FR, whereas if the sensor 17 is abnormal, the Po value is set based on the estimated residual fuel amount FRE.

Further, in the above described first to third embodiments, the interior of the fuel tank 9 is excessively negatively pressurized to a higher degree than required by utilizing negative pressure in the intake pipe during operation of the engine, so that the negatively pressurized state is maintained even after stoppage of the engine. This, however, is not limitative. Alternatively, the interior of the fuel tank 9 may be negatively pressurized by a pump driven, e.g. by a battery of the vehicle.

In the above described first to third embodiments, the interior of the fuel tank is excessively negatively pressured to a higher degree than required during operation of the engine, to thereby hold the fuel tank in a negatively pressurized state not only during operation of the engine but also during stoppage of the same. As a result, even when the filler cap is removed for refueling, the evaporative fuel in the fuel tank can be prevented from emitting into the air.

According to the above described first embodiment, however, the fuel tank is always negatively pressurized during operation of the engine, and therefore volatile ingredients of fuel in the fuel tank are likely to evaporate with the lapse of time, which can result in that the fuel cannot preserve its properties as fuel, i.e. the fuel changes in to a so-called "dead state" or "deteriorated state".

Further, fuel is more unlikely to evaporate as it is deteriorated to a higher degree, which dispenses with the need of excessive negative pressurization of the fuel tank. If the desired pressure value of the fuel tank is set irrespective of the deteriorated state of fuel, the fuel tank can be negatively pressurized beyond the required degree of negative pressurization. Such negative pressurization beyond the required degree can further promote the deterioration of the fuel.

Next, description will be made of a fourth embodiment of the invention which eliminates the above-mentioned inconvenience.

The construction of an evaporative emission control system of the present embodiment is identical with the construction of the first embodiment, however, a manner of setting the desired pressure value Po executed at the step S4 in FIG. 2 is distinguished from the manner employed in the first embodiment. Therefore, only the distinguished manner will be described hereinbelow with reference to FIGS. 12 to 17.

Figure 12:
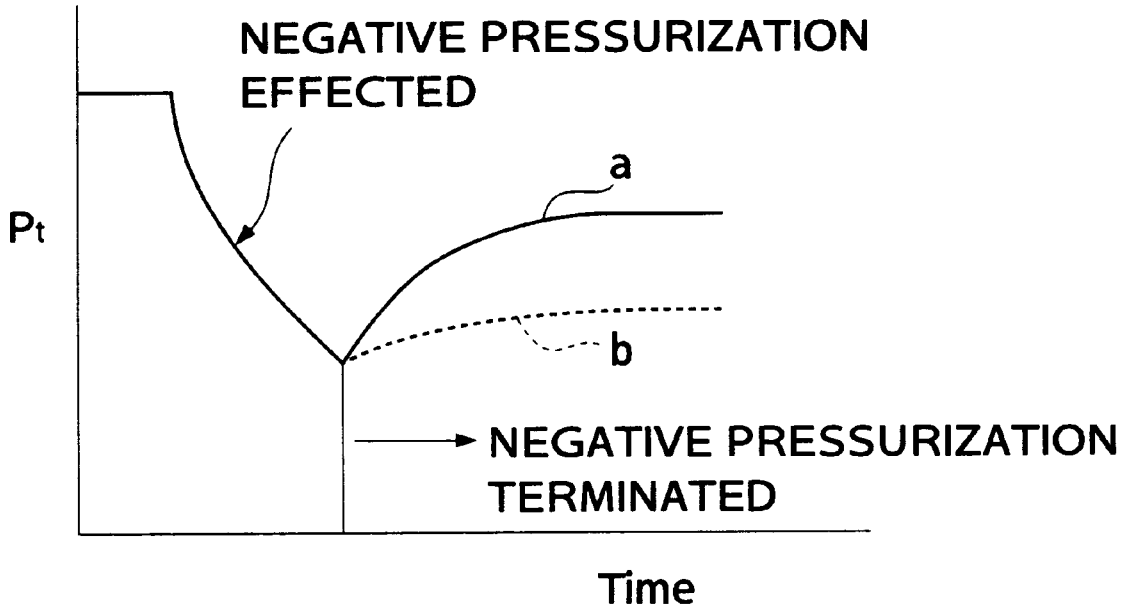
FIG. 12 is a graph showing changes in the tank internal pressure Pt with fuel in a normal state (not in a dead or deteriorated state) and with fuel in a deteriorated state, upon termination of negative pressurization, according to a fourth embodiment of the invention.

FIG. 12 is a graph useful in explaining changes in the tank internal pressure Pt after negative pressurization. In the figure, a change in the tank internal pressure Pt assumed when the fuel is in a normal state (not in a deteriorated state) is depicted by the solid line a, while a change in the tank internal pressure Pt assumed when the fuel is in a deteriorated state is depicted by the broken line b.

As stated before, even after negative pressurization of the fuel tank 9, the tank internal pressure Pt increases due to factors that the volatile ingredients of fuel evaporate at temperatures lower than the fuel temperature Tg, due to a heat held by the fuel at the fuel temperature Tg, and part of the fuel evaporates with a rise in the fuel temperature Tg within the fuel tank 9 caused by elevation of the outside air temperature TA, etc.

However, since the interior of the fuel tank 9 is always negatively pressurized, volatile ingredients evaporate, and therefore the fuel in the fuel tank 9 is likely to deteriorate into the so-called "dead state". In other words, the amount of volatile ingredients contained in fuel in the fuel tank 9 decreases as the fuel becomes deteriorated. Therefore, as is apparent from FIG. 12, if the fuel in the fuel tank is deteriorated, the tank internal pressure Pt (indicated by the broken line b) does not rise to such a high level as the tank internal pressure Pt with the fuel in the normal state (indicated by the solid line a). That is, for the deteriorated fuel negative pressurization is not required to the same extent as for the fuel in the normal state.

Figure 13:
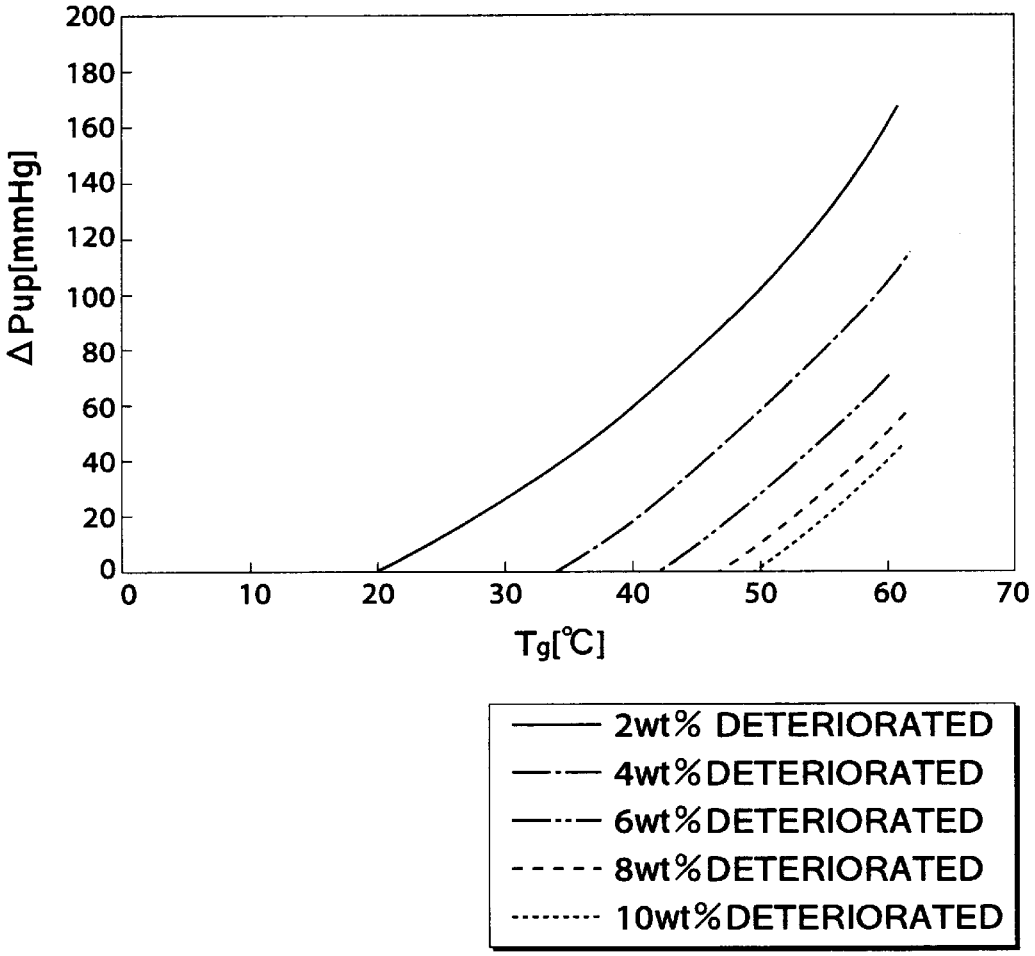
FIG. 13 is a graph showing rates of change in the tank internal pressure Pt according to the fuel temperature Tg as well as a deterioration degree of fuel.

FIG. 13 shows the relationship between the fuel temperature Tg and an amount of increase ΔPup (mmHg) in the tank internal pressure depending on the "deterioration degree" of fuel. In the figure, the ordinate indicates the amount of increase ΔPup (mmHg) in the tank internal pressure after termination of negative pressurization, while the abscissa indicates the fuel temperature Tg (°C.) within the fuel tank 9. The deterioration degree of fuel can be represented by a ratio in weight of evaporated fuel to a unit weight of fuel. As is apparent from the figure, the amount of increase ΔPup (mmHg) in the tank internal pressure Pt after negative pressurization in relation to the fuel temperature Tg becomes smaller as the deterioration degree of fuel is larger. Further, the amount of increase ΔPup (mmHg) in the tank internal pressure Pt becomes larger as the fuel temperature Tg is higher.

As described hereinabove, it is known that the amount of increase ΔPup (mmHg) in the tank internal pressure Pt becomes smaller as the deterioration degree of fuel is larger. Therefore, in the present embodiment, the deterioration degree of fuel is estimated by calculating the amount of increase ΔPup in the tank internal pressure Pt, and then the desired pressure value Po is shifted toward the side of the atmospheric pressure as the estimated deterioration degree of fuel is larger.

Figure 14:
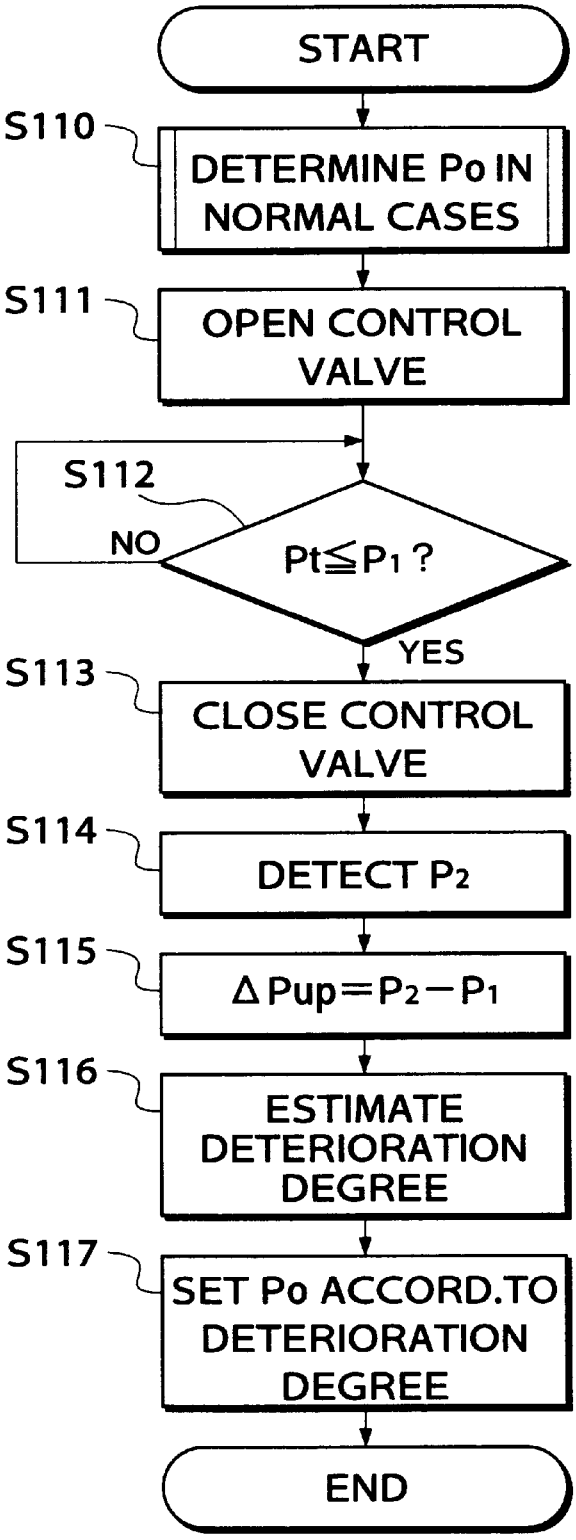
FIG. 14 is a flowchart showing a subroutine for determining the Po value, which is executed at the step S4 in FIG. 2 according to the fourth embodiment.
Figure 15:
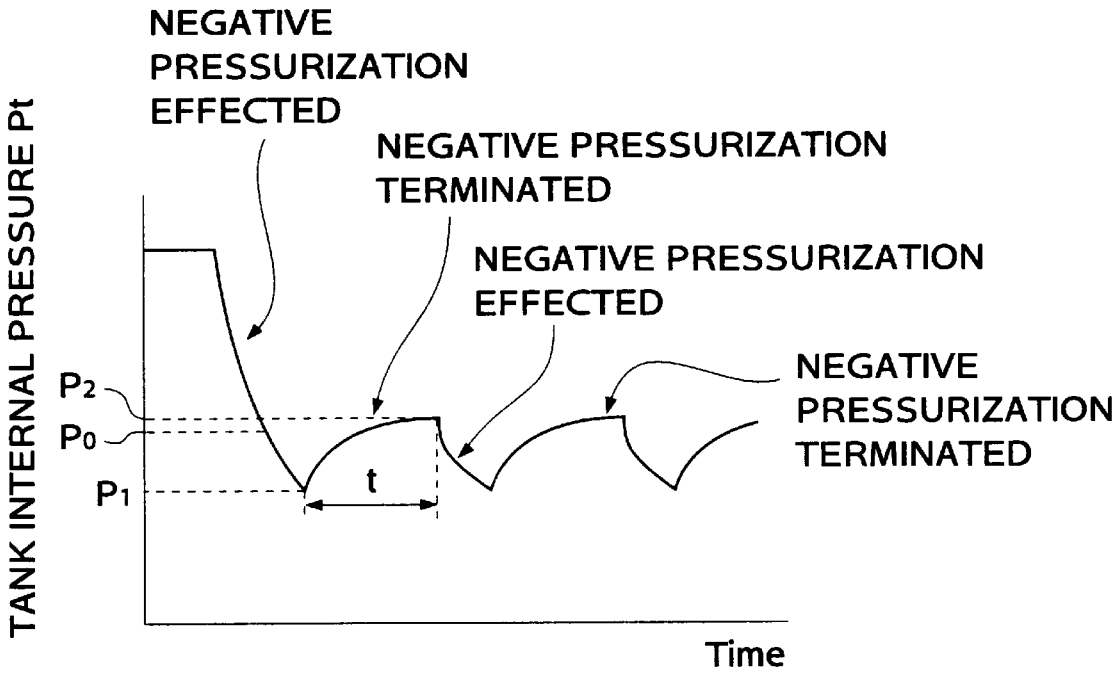
FIG. 15 is a graph useful in explaining a manner of determining the deterioration degree.

FIG. 14 shows a subroutine for setting the desired pressure value Po, and FIG. 15 shows a manner of estimating the deterioration degree of fuel in the fuel tank 9. The Program for carrying out the flowchart of FIG. 14 is stored in the memory circuit comprised of a ROM, etc., in the ECU 5, and executed by the CPU of the ECU 5.

First, at a step S110 in FIG. 14, the desired pressure value Po within the fuel tank 9 is determined according to the manner of setting the Po value, as shown in FIG. 3, referred to hereinbefore. Then, the control valve 30 is opened for negative pressurization of the tank internal pressure Pt at a step S111, and it is determined at a step S112 whether or not the tank internal pressure Pt falls below a pressure value P1 slightly lower than the desired pressure value Po, as shown in FIG. 15. If the tank internal pressure Pt does not fall below the pressure value P1, the step S112 is repeatedly executed.

If the tank internal pressure Pt falls below the pressure value P1, the control valve 30 is closed to terminate negative pressurization at a step S113, and upon the lapse of a predetermined time period tc after the closure of the control valve 30, a pressure value P2 then assumed is detected at a step S114, to thereby calculate the amount of increase ΔPup in the tank internal pressure, based on the difference between the pressure values P1 and P2 at a step S115.

Figure 16:
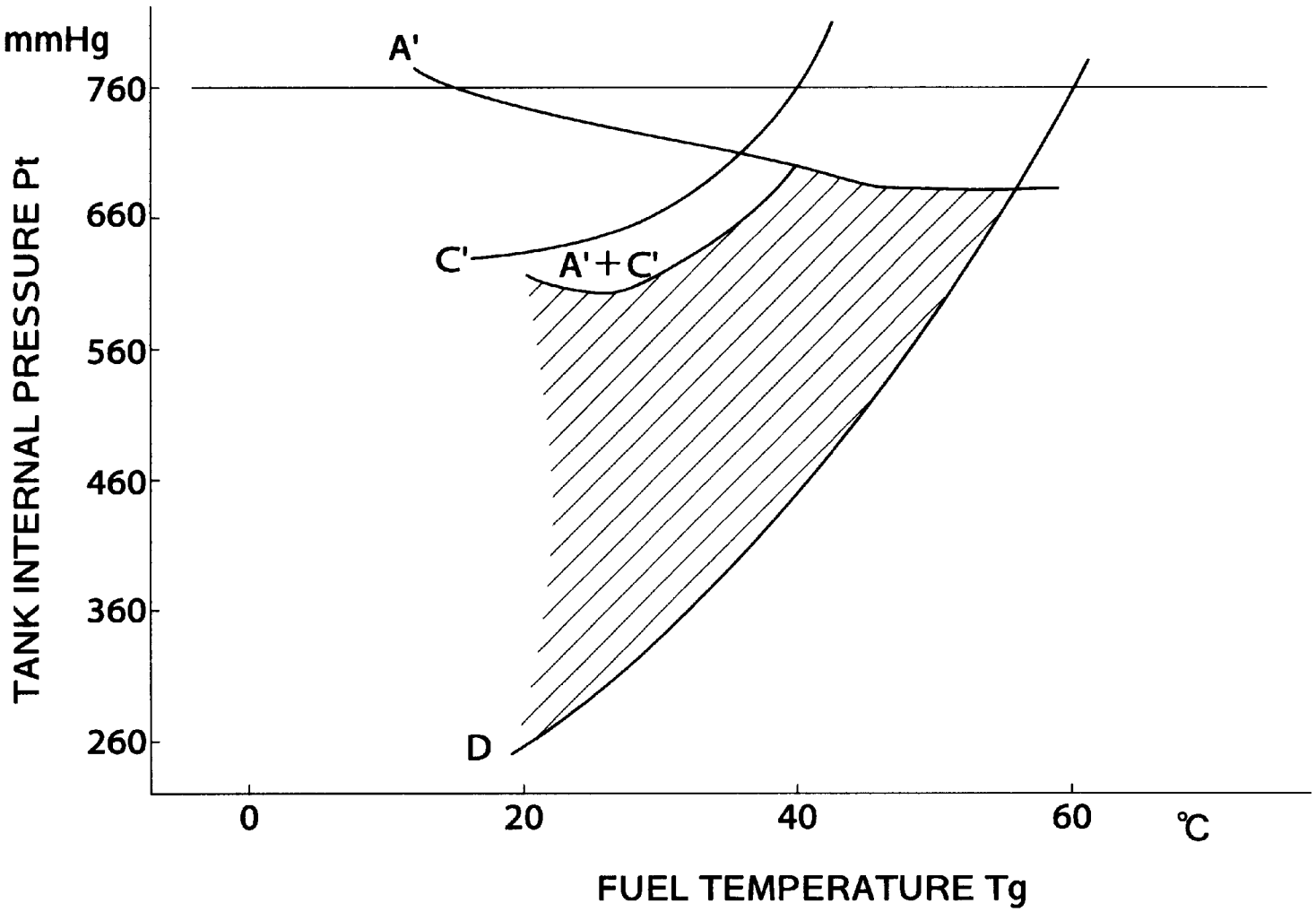
FIG. 16 is a graph useful in explaining a manner of determining a desired pressure value Po' to be set when fuel is in the deteriorated state.

Since there is the relationship between the amount of increase ΔPup and the deterioration degree of fuel, as shown in FIG. 13, the latter can be estimated based on the calculated amount of increase ΔPup and the fuel temperature Tg detected by the fuel temperature sensor 16 at a step S116, and then a desired pressure value Po corresponding to the deterioration degree is set according to a manner of setting the desired pressure value Po as shown in FIG. 16, hereinafter referred to, at a step S117, followed by terminating the present routine.

In estimating the deterioration degree of fuel according to the above estimating manner, the amount of increase ΔPup in the tank internal pressure Pt is calculated only once, and the deterioration degree is directly estimated from the thus calculated ΔPup value, but this is not limitative. Alternatively, the negative pressurization of the fuel tank 9 and the calculation of the ΔPup value over the predetermined time period tc may be carried out a plurality of times to obtain an average value of the calculated ΔPup values, to thereby estimate the deterioration degree based on the average value.

When the fuel in the fuel tank 9 is in a normal state (not in a deteriorated state), to maintain the interior of the fuel tank 9 under negative pressure even after stoppage of the engine 1, the desired pressure value Po needs to be set to a value which satisfies all the conditions defined by the curves A, C, A+C and D in FIG. 3, that is, the tank internal pressure Pt (i.e. the desired pressure value Po) needs to be controlled so as to fall in a range indicated by the shaded portion in FIG. 3, according to the fuel temperature Tg.

FIG. 16 shows the manner of setting the desired pressure value Po0 according to the deterioration degree, which is executed at the step S117 in FIG. 14. In the figure, the abscissa indicates the fuel temperature Tg (°C.), while the ordinate indicates the tank internal pressure Pt (mmHg) expressed in absolute pressure. A lower portion of the ordinate indicates a lower pressure value.

As described hereinabove, when the fuel is deteriorated, the desired pressure value Po should be set to a value closer to the atmospheric pressure than the desired pressure value Po for fuel in a normal state. Therefore, when the fuel is deteriorated, as shown in FIG. 16, the desired pressure value Po needs to be set to a value which satisfies all conditions defined by curves A', C', A'+C', and the curve D, that is, a shaded portion indicated in FIG. 16. The curves A' and C' are obtained by shifting the curves A and C in FIG. 3 toward the atmospheric pressure side, respectively, and the curve A'+C' is obtained from the curves A' and C'.

Therefore, at the step S117, the desired pressure value Po is set by using a map which is set so as to satisfy the conditions indicated in FIG. 16 according to the deterioration degree of fuel.

The amounts of shift of the curves A', C', and A'+C' from the respective curves A, C, and A+C are determined based on ΔPup values experimentally obtained.

Further, set values of the desired pressure value Po are stored in the memory circuit of the ECU 5 in the form of a plurality of maps. That is, since the amount of increase ΔPup in the tank internal pressure Pt varies depending on the deterioration degree of fuel, a plurality of maps corresponding to different values of the deterioration degree are stored in the memory circuit, and. a map corresponding to the value of deterioration degree estimated at the step S116 is selected for use in setting the desired pressure value Po.

Alternatively, in place of using a plurality of maps, only a single map may be stored in the memory circuit of the ECU 5. In this case, a shift amount is determined according to the deterioration degree and added to a map value of the desired pressure value Po retrieved from the map of FIG. 3.

As described hereinabove, according to the present embodiment, the amount of increase ΔPup in the tank internal pressure Pt is determined, and the desired pressure value Po is set according to the deterioration degree obtained based on the thus determined ΔPup value and the fuel temperature Tg. As a result, negative pressurization of the fuel tank can be carried out in a manner compensating for the deterioration of fuel during operation and even at stoppage of the engine, and hence the fuel tank can be prevented from being excessively negatively pressurized, to thereby keep the deterioration of fuel to the minimum.

In the above described first embodiment, the tank internal pressure is controlled in a feedback manner depending on the pressure detected by the tank internal pressure sensor, and therefore, if the tank internal pressure sensor becomes defective, the feedback control cannot be carried out in a suitable manner. In addition, the desired pressure value is determined according to the fuel temperature, and therefore, if the fuel temperature sensor becomes defective, the desired pressure value cannot be properly determined. In such an event, the tank internal pressure cannot be properly negatively pressurized.

Next, a fifth embodiment of the invention which eliminates the above-mentioned inconvenience will be described. The fifth embodiment is distinguished from the first embodiment only in the evaporative emission control process, which will be described with reference to FIG. 17.

First, it is determined at a step S201 whether or not the engine 1 is operating, e.g. by detecting cranking of the same. If the engine 1 is operating, a value of the tank internal pressure Pt detected by the tank internal pressure sensor 15 is fetched at a step S202, and then it is determined at a step S203 whether or not the fuel temperature (Tg) sensor 16 is defective.

Whether the fuel temperature sensor 16 is defective is determined based on the output from the sensor 16. More specifically, it is determined that the fuel temperature sensor 16 is defective if the output from the fuel temperature sensor 16 corresponds to a fuel temperature which cannot be assumed in normal conditions. For example, if the output from the fuel temperature sensor 16 corresponds to "a temperature value above 100° C.", the fuel temperature sensor 16 is assumed to be short-circuited, whereas if the output from the fuel temperature sensor 16 corresponds to "a temperature value below −50° C.", the fuel temperature sensor 16 is assumed to be disconnected, and in both the cases it is determined that the fuel temperature sensor 16 is defective.

If it is determined at the step S203 that the fuel temperature sensor 16 is not defective, the value of fuel temperature Tg detected by the fuel temperature sensor 16 is fetched at a step S204, and the desired pressure value Po is determined in the manner described with reference to FIG. 3 of the first embodiment, at a step S205.

Then, it is determined at a step S206 whether or not the tank internal pressure sensor 15 is defective. Whether the tank internal pressure sensor 15 is defective is determined based on the output from the sensor 15. More specifically, it is determined that the tank internal pressure sensor 15 is defective if the output from the tank internal pressure sensor 15 corresponds to a tank internal pressure value which cannot be assumed in normal conditions. For example, if the output from the tank internal pressure sensor 15 corresponds to "a pressure value above 1060 mmHg", the tank internal pressure sensor 15 is assumed to be short-circuited, whereas if the output from the tank internal pressure sensor 15 corresponds to "a pressure value below 160 mmHg", the tank internal pressure sensor 15 is assumed to be disconnected, and in both the cases it is determined that the tank internal pressure sensor 15 is defective. Alternatively to the above-mentioned determination, if the output from the tank internal pressure sensor 15 does not change even when the output from the fuel temperature sensor 16 has changed, it may be determined that tank internal pressure sensor 15 is defective.

If it is determined at the step S206 that the tank internal pressure sensor 15 is not defective, a difference ΔP between the tank internal pressure Pt and the desired pressure value Po is calculated at a step S207, and the control valve 30 is controlled such that the difference ΔP becomes equal to 0 at a step S208, followed by terminating the present routine. Thus, the tank internal pressure Pt is controlled to the desired pressure value Po.

On the other hand, if it is determined at the step S201 that the engine 1 is not operating, the CPU of the ECU 5 closes the control valve 30 in order to hold the negative pressure within the fuel tank 9 controlled to the desired pressure value Po at a step S209, followed by terminating the present routine.

If it is determined at the step S203 that the Tg sensor 16 is defective, the desired pressure value Po is set to a predetermined value Pd at a step S210. The predetermined value Pd is set, e.g. to the lower limit value (460 mmHg, indicated by the curve D in FIG. 3) of the desired pressure value Po assumed when the outside air temperature is 45° C.

Then, it is determined at a step S211 whether or not the intake pipe absolute pressure PBA is equal to or below the desired pressure value Po. If PBA≦Po holds, the steps S207, et seq. are executed. Thus, the tank internal pressure Pt is feedback controlled with the desired pressure value Po thus set to the predetermined value Pd, whereby the tank internal pressure Pt can be controlled to and held at the predetermined value Pd even when the fuel temperature sensor 16 is defective.

On the other hand, if PBA>Po holds at the step S211, the Program Proceeds to the step S209. Thus, if the tank internal pressure Pt cannot be controlled to the desired pressure value Po because negative pressure prevailing in the intake pipe 2 is higher than the desired pressure value Po, the control valve 30 can be avoided from opening and hence at least a further increase in the tank internal pressure Pt can be avoided if the Pt value exceeds the desired pressure value Po.

If it is determined at the step S206 that the tank internal pressure sensor 15 is defective, it is determined at a step S212 whether or not the intake pipe absolute pressure PBA is lower than the desired pressure value Po. If PBA<Po holds, the control valve 30 is opened at a step S214, followed by terminating the present routine. Thus, the tank internal pressure Pt can be held to a value corresponding to the intake pipe absolute pressure PBA. On the other hand, if PBA≧Po holds, the control valve 30 is closed at a step S213, followed by terminating the present routine. Thus, even if the tank internal pressure sensor 15 is defective, at least a further increase in the tank internal pressure Pt can be avoided when the Pt value exceeds the desired pressure value Po.

Figure 17:
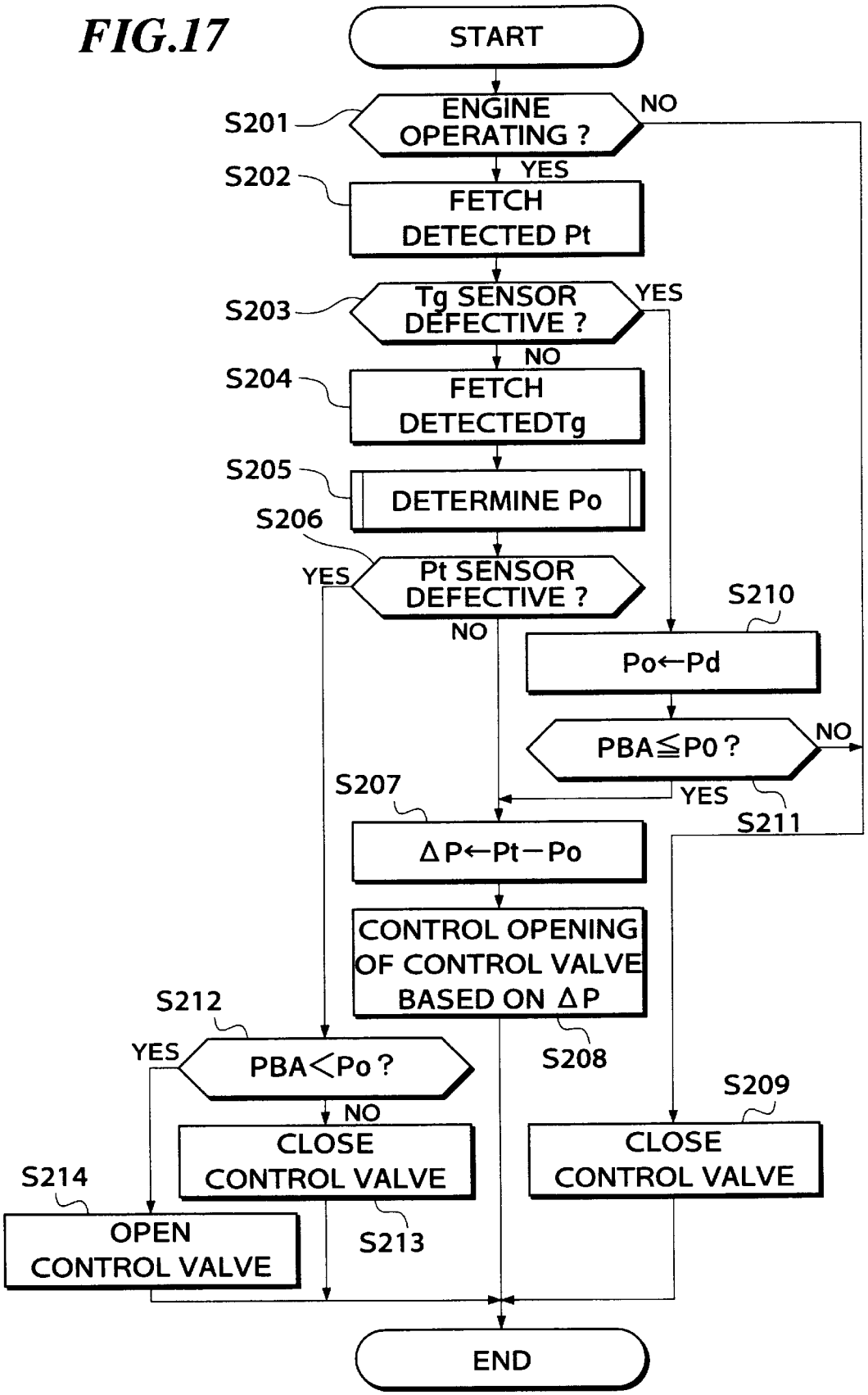
FIG. 17 is a flowchart showing a routine for carrying out an evaporative emission control process according to a fifth embodiment of the invention.

By virtue of the FIG. 17 Process, normally the tank internal pressure Pt is feedback-controlled to the desired pressure value Po which is determined according to the fuel temperature Tg, etc. When the fuel temperature sensor 16 is defective, the desired pressure value Po is set to the predetermined value Pd, and the tank internal pressure Pt is feedback-controlled to the thus set Po value. On the other hand, when the tank internal pressure sensor 15 is defective, the feedback control based on the output from the tank internal pressure sensor 15 is not carried out, and only when the intake pipe absolute pressure PBA is lower than the desired pressure value Po determined according to the fuel temperature Tg, etc., the tank internal pressure Pt is controlled to and held at a value corresponding to the intake pipe absolute pressure PBA.

According to the present embodiment, normally, the negative pressure within the intake pipe 2 is caused to influence the interior of the fuel tank 9 by controlling the opening of the control valve 30, to control and hold the tank internal pressure Pt to and at the desired pressure value Po determined according to the fuel temperature Tg, etc.

Further, even when the fuel temperature sensor 16 is defective, at least a further increase in the Pt value can be avoided if the Pt value exceeds the desired pressure value Po. If the intake pipe absolute pressure PBA is below the desired pressure value Po, the Pt value can be controlled to and held at the predetermined value Pd.

Still further, even when the tank internal pressure sensor 15 is defective, a further increase in the Pt value can be avoided if the Pt value at least exceeds the desired pressure value Po. If the intake pipe absolute pressure PBA is below the desired pressure value Po, the Pt value can be controlled to and held at a value corresponding to the intake pipe absolute pressure PBA.

As a result, not only when the engine 1 is operating or in stoppage, but also when the tank internal pressure sensor 15 and/or the fuel temperature sensor 16 is defective, negative pressurization of the fuel tank 9 can be carried out to the maximum possible extent while avoiding inappropriate or unnecessary control of the tank internal pressure Pt. As a result, the negatively pressurized state of the fuel tank 9 can be easily held, and therefore evaporative fuel in the fuel tank 9 can be prevented from emitting into the air in a more suitable manner, even if the filler cap 11 is removed for refueling. In addition, since the interior of the fuel tank 9 is negatively pressurized, the use of a canister is dispensed with, to thereby prevent emission of evaporative fuel with a simple construction and at a low cost.

In the above described embodiments, the engine is arranged in a front portion of the vehicle while the fuel tank is arranged in a rear portion of the same, like an ordinary automotive vehicle, which renders the evaporative fuel passage long in length. As a result, evaporative fuel generated in the fuel tank can be cooled and liquefied while it flows through the evaporative fuel passage due to negative pressure from the intake pipe. When the liquefied fuel is directly supplied into the intake pipe, a drastic change occurs in the air-fuel ratio of a mixture supplied to the engine, to adversely affect exhaust emission characteristics and drivability of the engine.

Next, description will be made of a sixth embodiment of the invention which eliminates the above-mentioned inconvenience. An evaporative emission control system of the sixth embodiment is distinguished from the first embodiment in that a gas-liquid separator 22 is further provided.

Figure 18:
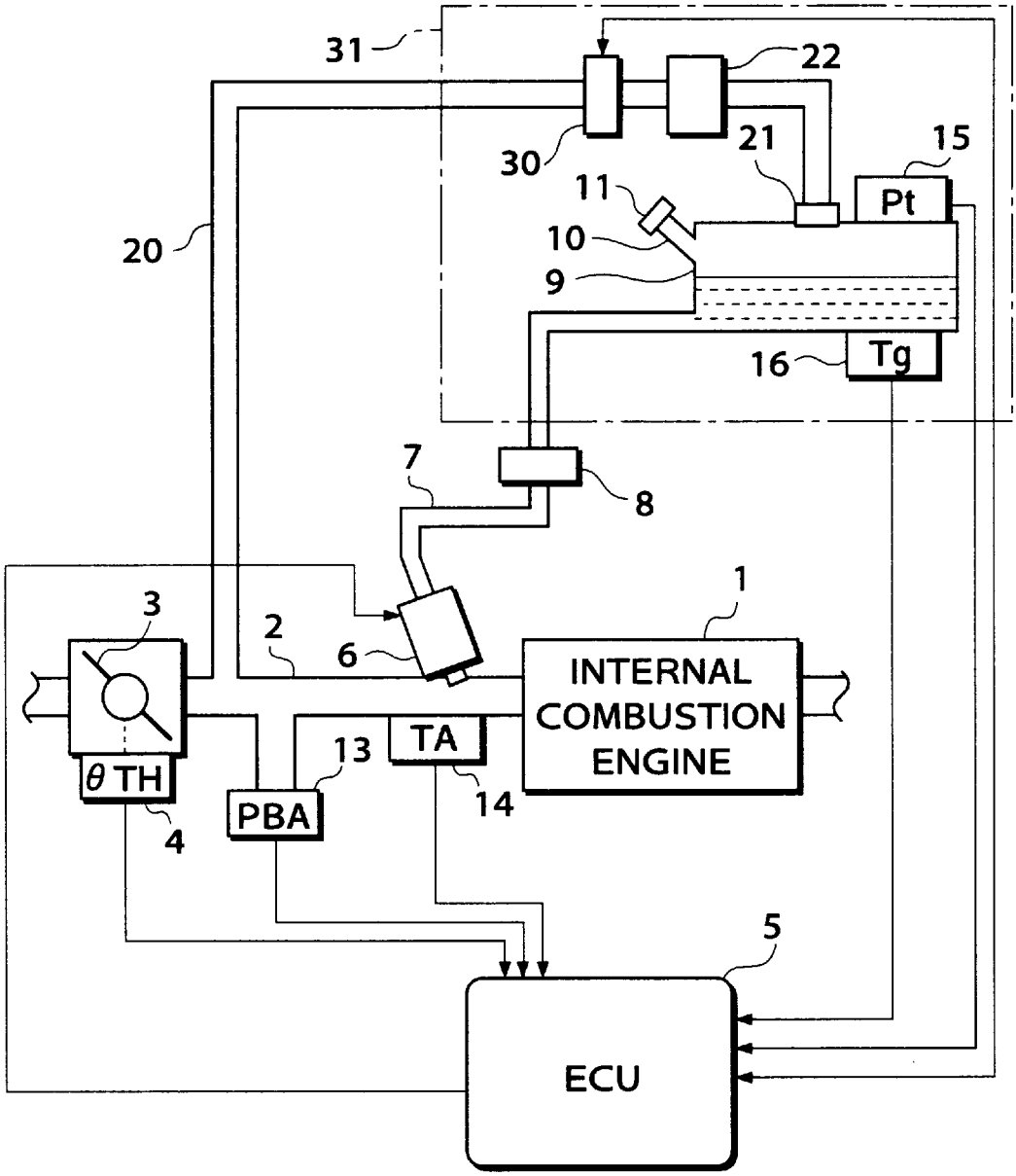
FIG. 18 is a block diagram schematically showing the arrangement of an internal combustion engine and an evaporative emission control system therefor, according to a sixth embodiment of the invention.

FIG. 18 shows the arrangement of the evaporative emission control system according to the present embodiment. In the figure, the gas-liquid separator 22 is inserted into the evaporative fuel passage 20 at a location between the control valve 30 and the cut-off valve 21. The other component parts of the system are identical with those of the first embodiment shown in FIG. 1, description thereof being omitted.

Figure 19:
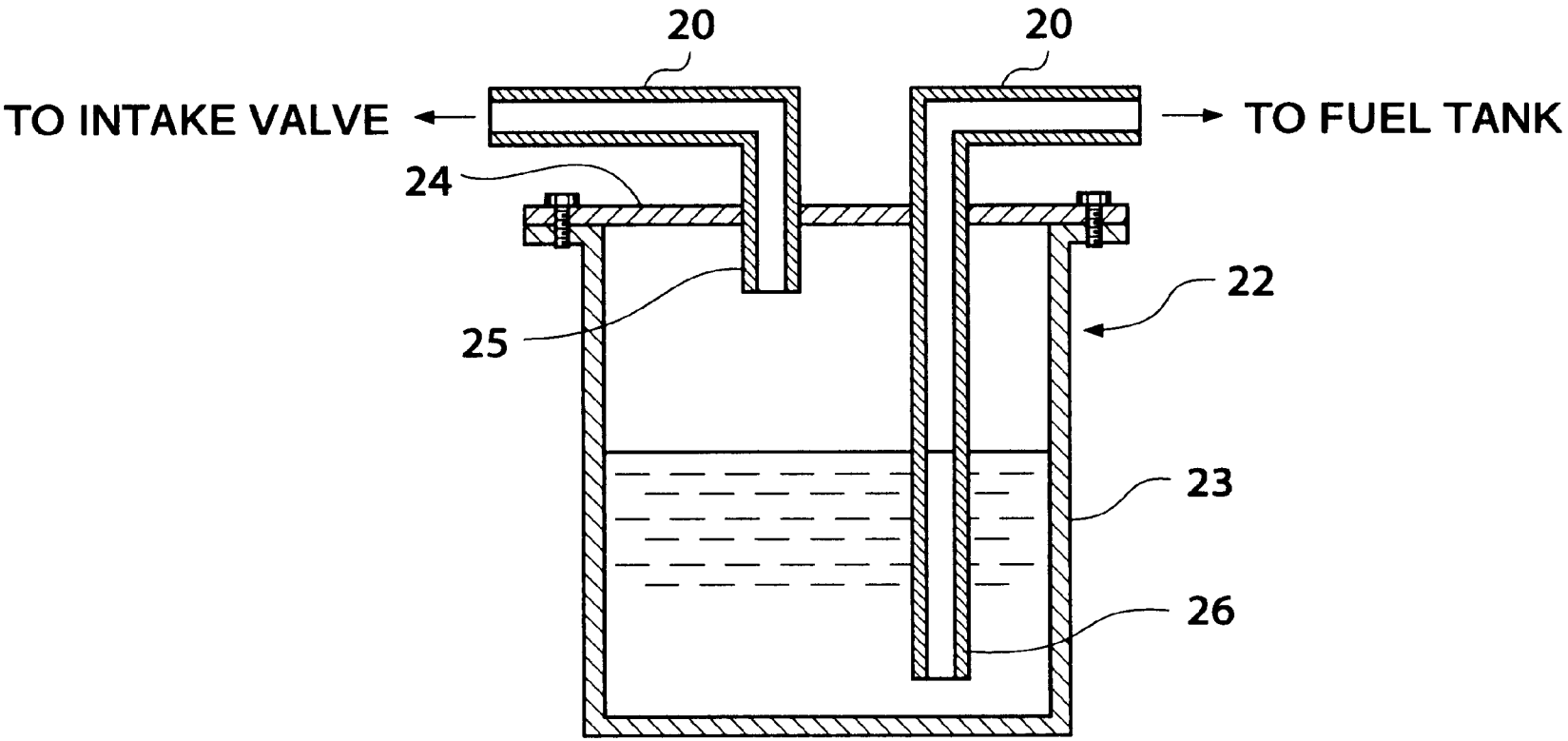
FIG. 19 is a diagram showing the construction of a gas-liquid separator appearing in FIG. 19.

FIG. 19 shows the construction of the gas-liquid separator 22 which is formed by a sealed container comprised of a box-shaped container 23 with its upper end opened, and a rid 24 fixed to the upper end of the container 23 by means of bolts, etc. to close the upper end. Inserted through the rid 24 are an end 25 of a portion of the evaporative fuel passage 20 extending from the intake pipe 2, which terminates immediately below the rid 24, and an end 26 of another portion of the same extending from the fuel tank 9, which terminates in the vicinity of the bottom of the container 23, i.e. at a height of 10 mm from the bottom of the container 23. With the above construction of the gas-liquid separator 22, even if evaporative fuel generated in the fuel tank 9 is cooled and liquefied in the evaporative fuel passage 20 while it is drawn through the evaporative fuel passage 20 due to negative pressure in the intake pipe 2, the liquefied fuel is transported from the end 26 of the evaporative fuel 20 into the container 23 of the gas-liquid separator 22 and detained within the container 23 without being further transported into the end 25 of the evaporative fuel passage 20, due to a difference in gravity between the evaporative fuel and the liquefied fuel. On the other hand, part of the evaporative fuel which has not been liquefied is transported from the end 25 through the evaporative fuel passage 20 into the intake pipe 2 of the engine 1. When the surface level of the fuel stored in the container 23 is higher than the level of the end 26, even if the liquefied fuel flowing from the end 26 is in atomized form, the liquefied fuel is surely detained the container 23.

The gas-liquid separator 22 is located within an engine compartment of the vehicle, not shown, which is close to the intake pipe 2, so as to facilitate detention of the liquefied fuel flowing through the evaporative fuel passage 20. Although, as shown in FIG. 18, the control valve 30 is arranged across the evaporative fuel passage 20 at a location between the gas-liquid separator 22 and the intake pipe 2, alternatively the control valve 30 may be arranged across the passage 20 at a location between the gas-liquid separator 22 and the fuel tank 9.

Figure 20:
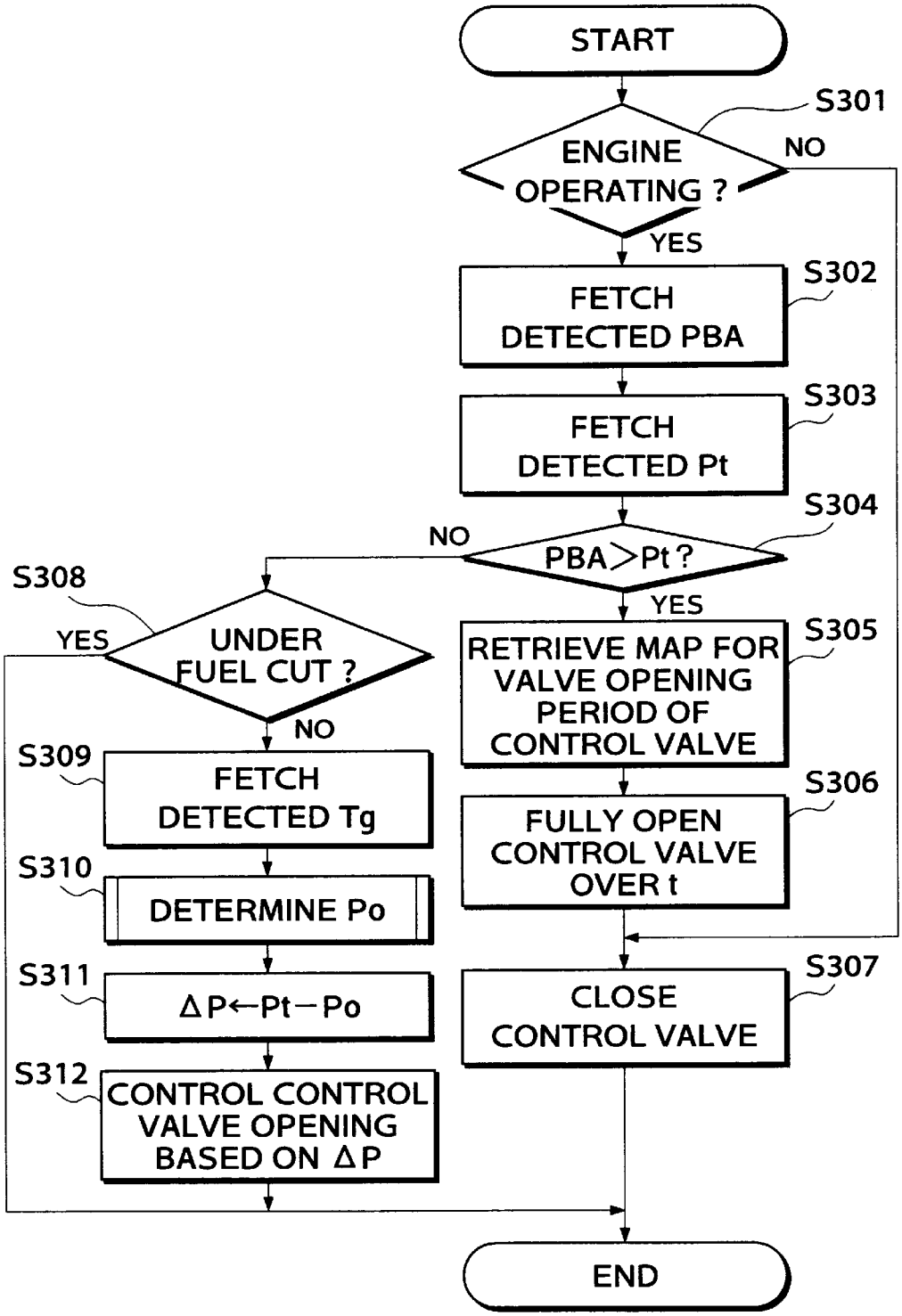
FIG. 20 is a flowchart showing a routine for carrying out an evaporative emission control process.

FIG. 20 shows a routine for carrying out an evaporative emission control process according to the sixth embodiment.

First, at a step S301, it is determined whether or not the engine is operating, e.g. by detecting cranking of the engine 1. If the engine 1 is operating, a value of the intake pipe absolute pressure PBA detected by the PBA sensor 13 is fetched at a steps s302, and a value of the tank internal pressure Pt detected by the Pt sensor 15 is fetched at a step S303. Then, it is determined at a step S304 whether or not the intake pipe absolute pressure PBA is higher than the tank internal pressure Pt.

If PBA>Pt holds at the step S304, a valve opening period t of the control valve 30 is retrieved from a map, referred to hereinafter with reference to FIG. 21, based on a ratio PBA/Pt at a step S305. Then, at a step S306, the control valve 30 is fully opened over the predetermined time period t retrieved at the step S305, and then the control valve 30 is fully closed at a step S307, followed by terminating the present routine. FIG. 22 shows how the control valve 30 is fully opened over the predetermined time period t.

On the other hand, if the engine 1 is in stoppage at the step S301, the Program jumps to the step S307, wherein the CPU of the ECU 5 closes the control valve 30 in order to maintain the negative pressure within the fuel tank 9 controlled to the desired pressure value Po, followed by terminating the present routine.

By virtue of the steps S301 to S307, when the PBA value is higher than the tank internal pressure Pt, the control valve 30 is opened over the predetermined time period t, to thereby forcibly return the fuel stored in the container 23 of the gas-liquid separator 22 to the fuel tank 9.

Figure 21:
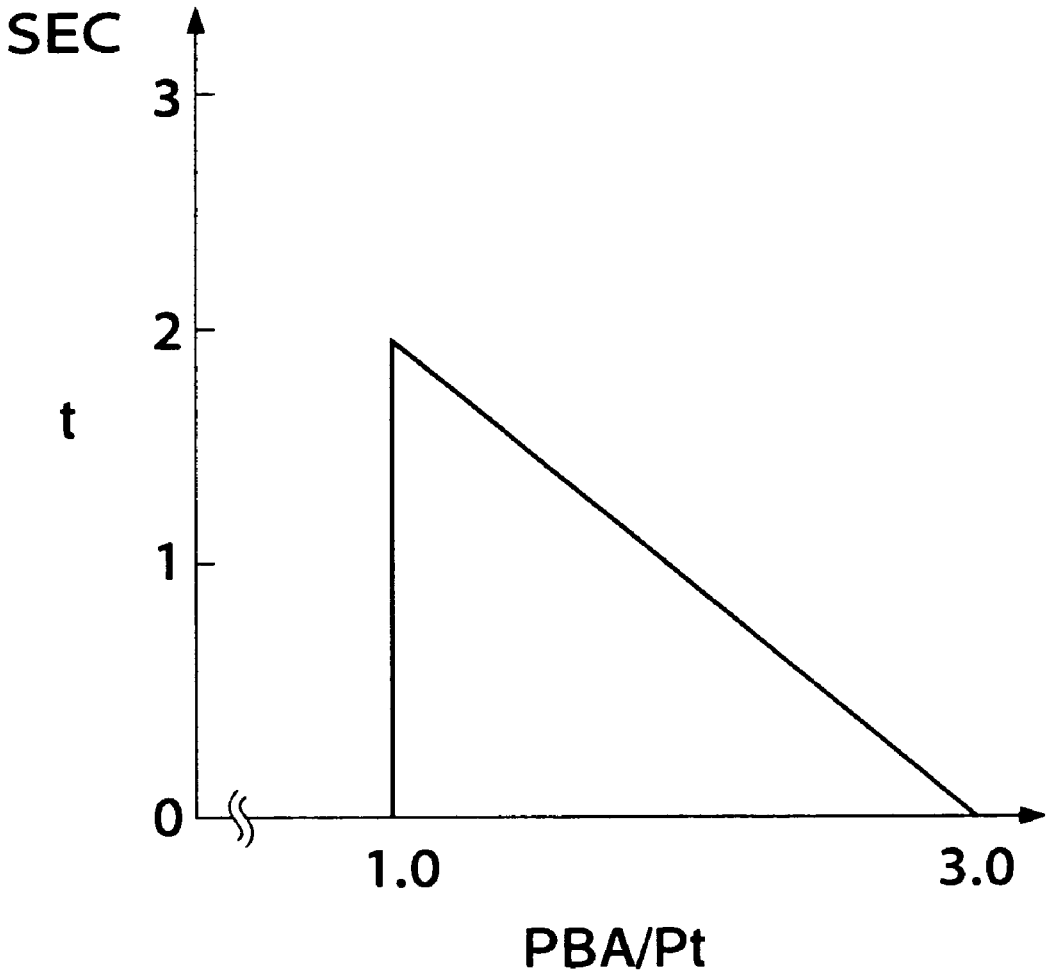
FIG. 21 is a map for determining a predetermined time period t over which a control valve appearing in FIG. 19 is to be fully opened, which is used at a step S305 in FIG. 20.
Figure 22:
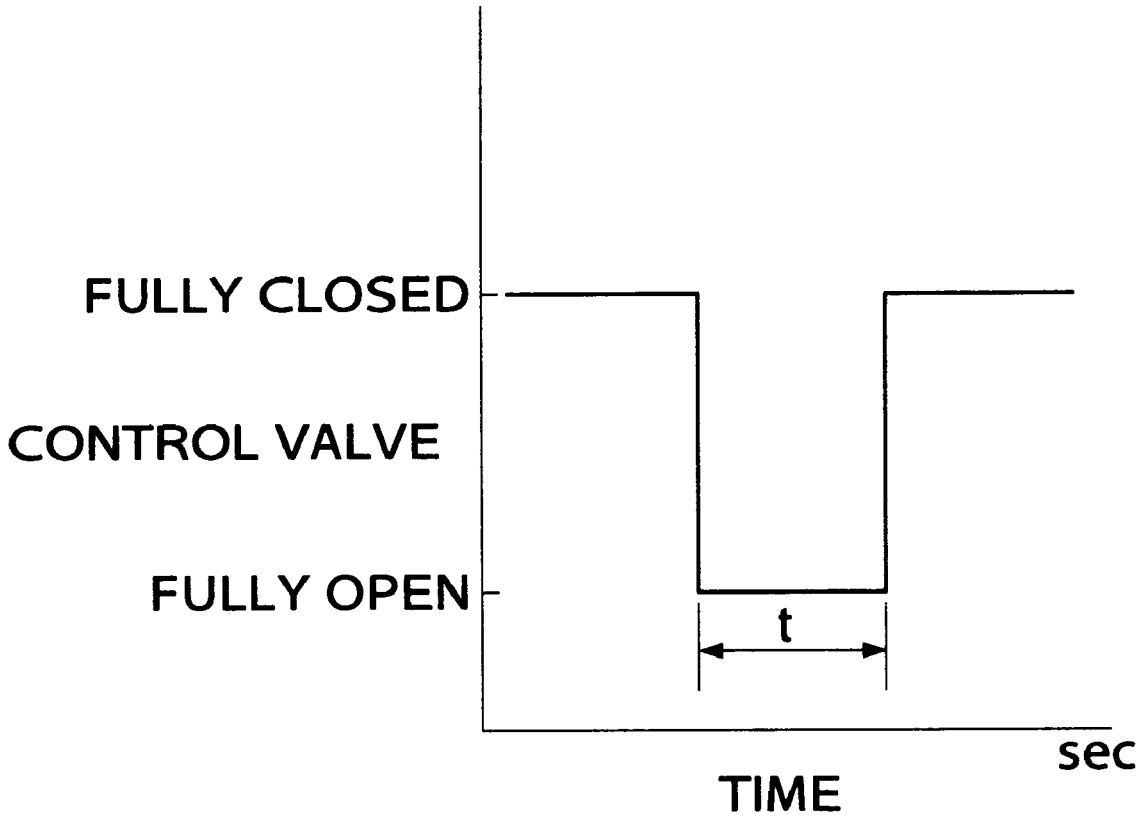
FIG. 22 is a graph useful in explaining how the control valve is fully opened over the predetermined time period t.

FIG. 21 shows the map for determining the predetermined time period t over which the control valve 30 is opened. In the figure, the abscissa indicates the ratio PBA/Pt of the intake pipe absolute pressure PBA to the tank internal pressure Pt, and the ordinate indicates the predetermined time period t (sec). The map is set such that the predetermined time period t is equal to 2 sec when PBA/Pt=1.0 holds, while the predetermined time period t becomes smaller as the ratio PBA/Pt increases when PBA/Pt≧1.0 holds. Further, the predetermined time period t is equal to 0 when the ratio PBA/Pt=3.0 holds. When PBA/Pt<1.0 holds, the predetermined time period t is set to 0.

Referring again to FIG. 20, if PBA≦Pt holds at the step S304, steps S308 to S312 are executed to excessively negatively pressurize the fuel tank 9 to a higher degree than required. First, at the step S308, it is determined whether or not fuel cut is being carried out. If fuel cut is not being carried out, it is determined that negative pressure within the intake pipe 2 can be maintained, and therefore a value of the fuel temperature Tg detected by the Tg sensor 15 is fetched at the step S309. Further, the desired pressure value Po (mmHg) within the fuel tank 9 is determined according to the manner described before with reference to FIG. 3 at the step S310. The Po value is set to a value excessively negatively pressurized to a higher degree than the actually required value in view of an expected increase in the tank internal pressure so that the interior of the fuel tank 9 can be held under negative pressure after stoppage of the engine 1.

Next, the difference ΔP between the tank internal pressure Pt detected at the step S303 and the desired pressure value Po is calculated at the step S311, and the control valve 30 is controlled such that the difference ΔP becomes equal to 0 at the step S312, followed by terminating the present routine.

By virtue of the steps S308 to S312, the opening of the control valve 30 is controlled during operation of the engine 1 to introduce the negative pressure prevailing the intake pipe 2 into the fuel tank 9, to thereby control the tank internal pressure Pt to the desired pressure value Po. As a result, not only during operation of the engine 1 but also during stoppage of the engine 1, the fuel tank 9 can be held in the negatively pressurized state, which can prevent evaporative fuel in the fuel tank 9 from emitting into the air even when the filler cap 11 is removed for refueling.

According to the present embodiment in particular, liquefied fuel in the evaporative fuel passage 20 is forcibly returned by the use of the gas-liquid separator 22 and the control valve 30 utilizing the absolute pressure PBA within the intake pipe 2, to thereby prevent the air-fuel ratio of the mixture supplied to the engine 1 from suddenly fluctuating.

In the above described embodiments, a predetermined value of 45° C. is selected as the highest possible outside air temperature to control the tank internal pressure Pt. However, temperature-setting means may be provided to freely set or select the highest possible outside air temperature to different values depending upon the outside air temperature of the vehicle, for example, to 45° C. in summer, and to 25° C. in winter, whereby the value of negative pressure within the fuel tank 9 can be controlled to a value appropriate to the ambient temperature of the vehicle, thus avoiding the interior of the fuel tank 9 from being under excessive negative pressure.

What is claimed is:

1. An evaporative emission control system for an internal combustion engine having an intake system and a fuel tank, comprising:

an evaporative fuel passage extending between said intake system and said fuel tank;

a control valve arranged across said evaporative fuel passage, for opening and closing said evaporative fuel passage; and control means for controlling opening of said control valve such that an interior of said fuel tank is under negative pressure during operation and stoppage of said engine.

2. An evaporative emission control system as claimed in claim 1, including a temperature sensor for detecting temperature of fuel within said fuel tank, and a pressure sensor for detecting pressure within said fuel tank, and wherein said control means determines a desired value of said pressure within said fuel tank according to said temperature of fuel detected by said temperature sensor, and controls said control valve such that said pressure within said fuel tank becomes equal to the determined desired value.

3. An evaporative emission control system as claimed in claim 1, including a temperature sensor for detecting temperature of fuel within said fuel tank, and a pressure sensor for detecting pressure within said fuel tank, and wherein said control means determines a desired value of said pressure within said fuel tank according to said temperature of fuel detected by said temperature sensor and a highest possible outside air temperature set beforehand, and controls said control valve such that said pressure within said fuel tank becomes equal to the determined desired value.

4. An evaporative emission control system as claimed in claim 3, wherein said control means determines said desired value of said pressure within said fuel tank, based on a first increase amount of said pressure within said fuel tank due to a heat held by said fuel within said fuel tank, and a second increase amount of said pressure within said fuel tank to be obtained when said temperature of said fuel rises to said highest possible outside air temperature.

5. An evaporative emission control system as claimed in claim 4, wherein said control means sets said desired value of said pressure within said fuel tank to such a value that said pressure within said fuel tank is excessively negatively pressurized to a higher degree than required in view of said first increase amount and said second increase amount, so as to maintain negative pressure within said fuel tank even after said engine is stopped.

6. An evaporative emission control system as claimed in claim 4, wherein said engine is an internal combustion engine for an automotive vehicle, said evaporative emission control system including setting means for setting said highest possible outside air temperature, said setting means setting said highest possible outside air temperature depending on an ambient temperature circumstance of said vehicle.

7. An evaporative emission control system for an internal combustion engine having a fuel tank, comprising:

residual fuel amount-detecting means for detecting a residual fuel amount within said fuel tank; and negative pressure control means for controlling pressure within said fuel tank to a negative pressure value;

and wherein said negative pressure control means controls said pressure within said fuel tank to a higher value as said residual fuel amount detected by said residual fuel amount-detecting means is larger.

8. An evaporative emission control system as claimed in claim 7, including fuel temperature-estimating means for estimating an increase amount of temperature of fuel within said fuel tank according to the detected residual fuel amount, and tank internal pressure increase amount-estimating means for estimating an increase amount of said pressure within said fuel tank according to the estimated increase amount of said temperature of said fuel, and wherein said negative pressure control means controls said pressure within said fuel tank to a higher value as the estimated increase amount of said pressure within said fuel tank is larger.

9. An evaporative emission control system as claimed in claim 8, including fuel temperature-detecting means for detecting temperature of said fuel within said fuel tank, and pressure-detecting means for detecting said pressure within said fuel tank, and wherein said negative pressure control means determines a desired value of said pressure within said fuel tank, based on the detected fuel temperature, the detected pressure within said fuel tank, and the estimated pressure increase amount, and controls said pressure within said fuel tank so as to become equal to said desired value.

10. An evaporative fuel control system for an internal combustion engine having a fuel tank, comprising:

residual fuel amount-detecting means for detecting a residual fuel amount within said fuel tank;

pressure-detecting means for detecting pressure within said fuel tank;

residual fuel amount-estimating means for estimating said residual fuel amount within said fuel tank; and negative pressure control means for controlling said pressure within said fuel tank to a negative pressure value;

and wherein said residual fuel amount-estimating means estimates said residual fuel amount, based on a rate of change in said pressure within said fuel tank occurring during operation of said negative pressure control means, and said negative pressure control means controls said pressure within said fuel tank to a higher value as the estimated residual fuel amount is larger.

11. An evaporative emission control system as claimed in claim 7, wherein said engine has an intake system, said evaporative emission control system including an evaporative fuel passage extending between said intake system and said fuel tank, and a control valve arranged across said evaporative fuel passage, for opening and closing said evaporative fuel passage, said negative pressure control means being formed of said evaporative fuel passage and said control valve.

12. An evaporative emission control system for an internal combustion engine having an intake system and a fuel tank, comprising:

an evaporative fuel passage extending between said intake system and said fuel tank;

a control valve arranged across said evaporative fuel passage, for opening and closing said evaporative fuel passage;

increase amount-calculating means for calculating an increase amount of pressure within said fuel tank obtained when said control valve has shifted from an open state to a closed value; and control means for determining a desired value of said pressure within said fuel tank according to said increase amount calculated by said increase amount-calculating means, and controlling opening of said control valve such that said pressure within said fuel tank becomes equal to the determined desired value.

13. An evaporative emission control system as claimed in claim 12, including temperature-detecting means for detecting temperature of fuel within said fuel tank, and wherein said control means determines said desired value of said pressure within said fuel tank according to said increase amount calculated by said increase amount-calculating means and said fuel temperature detected by said temperature-detecting means.

14. An evaporative emission control system as claimed in claim 12, wherein said increase amount-calculating means calculates said increase amount of said pressure within said fuel tank a plurality of times to calculate an average value of said increase amount, said control means determining said desired value of said pressure within said fuel tank according to the calculated average value.

15. An evaporative emission control system as claimed in claim 12, wherein said control means sets said desired value of said pressure within said fuel tank to a higher value as said increase amount calculated by said increase amount-calculating means is smaller.

16. An evaporative emission control system for an internal combustion engine having an intake system and a fuel tank, comprising:

an evaporative fuel passage extending between said intake system and said fuel tank;

a control valve arranged across said evaporative fuel passage, for opening and closing said evaporative fuel passage;

a temperature sensor for detecting temperature of fuel within said fuel tank;

an intake system internal pressure sensor for detecting pressure within said intake system;

a tank internal pressure sensor for detecting pressure within said fuel tank; and control means operable when said tank internal pressure sensor is defective, for opening said control valve if said pressure within said intake system detected by said intake system internal pressure sensor is lower than a desired value of said pressure within said fuel tank determined according to said temperature of fuel detected by said temperature sensor.

17. An evaporative emission control system as claimed in claim 16, wherein said control means controls said control valve such that said pressure within said fuel tank becomes equal to said desired value when said tank internal pressure sensor is not defective.

18. An evaporative emission control system for an internal combustion engine having an intake system and a fuel tank, comprising:

an evaporative fuel passage extending between said intake system and said fuel tank;

a control valve arranged across said evaporative fuel passage, for opening and closing said evaporative fuel passage;

a temperature sensor for detecting temperature of fuel within said fuel tank;

an intake system internal pressure sensor for detecting pressure within said intake system;

a tank internal pressure sensor for detecting pressure within said fuel tank; and control means operable when said temperature sensor is defective, for controlling said control valve such that said pressure within said fuel tank becomes equal to a predetermined value.

19. An evaporative emission control system as claimed in claim 18, wherein said control means closes said control valve when said pressure within said intake system detected by said intake system internal pressure sensor is higher than said predetermined value.

20. An evaporative emission control system as claimed in claim 19, wherein said control means controls said control valve such that said pressure within said fuel tank becomes equal to said predetermined value when said pressure within said intake system detected by said intake system internal pressure sensor is lower than said predetermined value.

21. An evaporative emission control system as claimed in claim 18, wherein said control means controls said control valve such that said pressure within said fuel tank becomes equal to a desired value determined according to said fuel temperature detected by said temperature sensor when said temperature sensor is not defective.

22. An evaporative emission control system for an internal combustion engine having an intake system and a fuel tank, comprising:

an evaporative fuel passage extending between said intake system and said fuel tank;

a control valve arranged across said evaporative fuel passage, for opening and closing said evaporative fuel passage;

gas-liquid separator means arranged across said evaporative fuel passage;

a first pressure sensor for detecting pressure within said intake system; and a second pressure sensor for detecting pressure within said fuel tank; and wherein said control means opens said control valve over a predetermined time period when a value of said pressure within said intake system detected by said first pressure sensor is higher than a value of said pressure within said fuel tank detected by said second pressure sensor.

23. An evaporative emission control system as claimed in claim 22, wherein said predetermined time period is determined based on a ratio of said pressure value within said intake system to said pressure value within said fuel tank.

24. An evaporative emission control system as claimed in claim 23, wherein said predetermined time period is set to a smaller value as said ratio of said pressure value within said intake system to said pressure value within said fuel tank increases within a range between first and second predetermined values, said second predetermined value being larger than said first predetermined value.

25. An evaporative emission control system as claimed in claim 5, wherein said engine is an internal combustion engine for an automotive vehicle, said evaporative emission control system including setting means for setting said highest possible outside air temperature, said setting means setting said highest possible outside air temperature depending on an ambient temperature circumstance of said vehicle.

26. An evaporative emission control system as claimed in claim 8, wherein said engine has an intake system, said evaporative emission control system including an evaporative fuel passage extending between said intake system and said fuel tank, and a control valve arranged across said evaporative fuel passage, for opening and closing said evaporative fuel passage, said negative pressure control means being formed of said evaporative fuel passage and said control valve.

27. An evaporative emission control system as claimed in claim 9, wherein said engine has an intake system, said evaporative emission control system including an evaporative fuel passage extending between said intake system and said fuel tank, and a control valve arranged across said evaporative fuel passage, for opening and closing said evaporative fuel passage, said negative pressure control means being formed of said evaporative fuel passage and said control valve.

28. An evaporative emission control system as claimed in claim 10, wherein said engine has an intake system, said evaporative emission control system including an evaporative fuel passage extending between said intake system and said fuel tank, and a control valve arranged across said evaporative fuel passage, for opening and closing said evaporative fuel passage, said negative pressure control means being formed of said evaporative fuel passage and said control valve.

29. An evaporative emission control system as claimed in claim 13, wherein said increase amount-calculating means calculates said increase amount of said pressure within said fuel tank a plurality of times to calculate an average value of said increase amount, said control means determining said desired value of said pressure within said fuel tank according to the calculated average value.

30. An evaporative emission control system as claimed in claim 13, wherein said control means sets said desired value of said pressure within said fuel tank to a higher value as said increase amount calculated by said increase amount-calculating means is smaller.

31. An evaporative emission control system as claimed in claim 19, wherein said control means controls said control valve such that said pressure within said fuel tank becomes equal to a desired value determined according to said fuel temperature detected by said temperature sensor when said temperature sensor is not defective.

32. An evaporative emission control system as claimed in claim 20, wherein said control means controls said control valve such that said pressure within said fuel tank becomes equal to a desired value determined according to said fuel temperature detected by said temperature sensor when said temperature sensor is not defective.

* * * * *